US012193546B2

(12) United States Patent
Tashjian

(10) Patent No.: US 12,193,546 B2
(45) Date of Patent: Jan. 14, 2025

(54) EARRINGS AND METHODS OF MANUFACTURE AND USE THEREOF

(71) Applicant: Venus by Maria Tash, Inc., New York, NY (US)

(72) Inventor: Maria Tashjian, New York, NY (US)

(73) Assignee: Venus by Maria Tash, Inc., New York, NY (US)

( * ) Notice: Subject to any disclaimer, the term of this patent is extended or adjusted under 35 U.S.C. 154(b) by 0 days.

(21) Appl. No.: 17/362,448

(22) Filed: Jun. 29, 2021

(65) Prior Publication Data

US 2021/0368950 A1 Dec. 2, 2021

Related U.S. Application Data

(63) Continuation-in-part of application No. 29/768,794, filed on Feb. 1, 2021, now Pat. No. Des. 945,919, and a continuation-in-part of application No. 17/163,825, filed on Feb. 1, 2021, now Pat. No. 11,596,210, and a continuation-in-part of application No. PCT/US2020/063231, filed on Dec. 4, 2020, said application No. 17/163,825 is a continuation of application No. 17/013,826, filed on Sep. 7, 2020, now Pat. No. 10,905,206, said application No. 29/768,794 is a continuation of application No. 17/013,826, filed on Sep. 7, 2020, now Pat. No. 10,905,206, which is a continuation-in-part of application No. 29/749,236, filed on Sep. 3, 2020, (Continued)

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/00; A44C 15/0035; Y10T 24/201; Y10T 24/3653; Y10T 24/41
USPC ..... 63/12, 13
See application file for complete search history.

(56) References Cited

U.S. PATENT DOCUMENTS

| | | | |
|---|---|---|---|
| 20,480 | A | 6/1858 | Carpenter |
| 130,771 | A | 8/1872 | Tryner |

(Continued)

FOREIGN PATENT DOCUMENTS

| | | |
|---|---|---|
| FR | 2886110 | 12/2006 |
| GB | 2244636 | 12/1991 |

(Continued)

OTHER PUBLICATIONS 10 pairs of tiny stud and hoop earrings that look really expensive, Get the Gloss, https://www.getthegloss.com/article/the-best-tiny-stud-and-hoop-earrings-to-buy-on-a-budget downloaded from Internet Nov. 2020 (1 page).

(Continued)

*Primary Examiner* — Jack W Lavinder
(74) *Attorney, Agent, or Firm* — Dentons US LLP

(57) ABSTRACT

An earring comprises: a housing including a cavity; a post extending out of the housing from within the cavity, wherein the post is externally threaded; a tube that is internally threaded; and a base from which the tube extends, wherein the cavity is configured to receive the tube such that (a) the post extends into the tube and (b) the post and the tube thread with each other while the tube spans between the housing and the base.

53 Claims, 13 Drawing Sheets

Related U.S. Application Data now Pat. No. Des. 1,008,863, application No. 17/362,448 is a continuation-in-part of application No. 29/725,925, filed on Feb. 27, 2020, now Pat. No. Des. 1,022,765, said application No. 17/013,826 is a continuation-in-part of application No. 29/725,811, filed on Feb. 27, 2020.

(60) Provisional application No. 62/944,888, filed on Dec. 6, 2019.

(56) References Cited

U.S. PATENT DOCUMENTS 292,810 A 2/1884 Hartmann
D32,523 S 4/1900 Zell
D136,958 S 10/1943 Rubel
D137,112 S 10/1943 Rubel
D139,254 S 8/1944 Philippe
D150,589 S 9/1947 Katz
D150,612 S 10/1947 Katz
D151,171 S 1/1948 Philippe
D154,608 S 1/1949 Katz
D156,271 S 7/1949 Philippe
D156,312 S 8/1949 Bogoff
D159,118 S 2/1950 Weinberg
2,502,386 A 3/1950 Mailand
D161,286 S 9/1950 Semensohn
D161,289 S 9/1950 Semensohn
D162,461 S 12/1950 Philippe
D164,946 S 7/1951 Philippe
D169,726 S 1/1953 Bell
D170,349 S 5/1953 Bell
D170,266 S 6/1953 Katz
D171,728 S 11/1953 Philippe
D171,708 S 3/1954 Katz
D173,990 S 2/1955 Katz
D176,782 S 1/1956 Katz
D177,121 S 3/1956 Katz
D187,812 S 5/1960 Randall
3,005,204 A * 10/1961 Silver ..... A41B 3/06 24/105
3,382,589 A 5/1968 Dowling
3,844,271 A 10/1974 Lake
D242,670 S 12/1976 Northup
D244,126 S 4/1977 Ladjimi
D244,920 S 7/1977 Kelman
D245,650 S 9/1977 Mueller et al.
D246,357 S 11/1977 Durante
D247,614 S 3/1978 Kelman
D248,380 S 7/1978 Burchett
D248,458 S 7/1978 Gatof et al.
D248,801 S 8/1978 Tafoya
D249,129 S 8/1978 Fishman
D249,130 S 8/1978 Fishman
D249,252 S 9/1978 Gatof
D249,337 S 9/1978 DiOrio
D250,456 S 12/1978 Fishman
D250,457 S 12/1978 Fishman
D250,516 S 12/1978 Fishman
D250,517 S 12/1978 Fishman
D251,715 S 5/1979 Fishman
D255,670 S 7/1980 Ambler
D255,885 S 7/1980 Andrews
D256,003 S 7/1980 Barr
D257,023 S 9/1980 Barr
D257,024 S 9/1980 Barr
D257,026 S 9/1980 Barr
D259,110 S 5/1981 Russell
D260,622 S 9/1981 Barr
D260,744 S 9/1981 Barr
D261,245 S 10/1981 Epstein
D261,246 S 10/1981 Epstein
D261,247 S 10/1981 Epstein
D261,372 S 10/1981 Fried
D262,272 S 12/1981 Block
D264,060 S 4/1982 Epstein
D265,641 S 8/1982 Bongiorno
D265,811 S 8/1982 Barr
D265,894 S 8/1982 Barr
D265,895 S 8/1982 Barr
D267,241 S 12/1982 Bulgari
D268,016 S 2/1983 Block
D271,952 S 12/1983 Altman
D272,327 S 1/1984 Bulgari
D272,994 S 3/1984 Serapiglia
D273,371 S 4/1984 Bulgari
D273,472 S 4/1984 Goldstein
D274,418 S 6/1984 Bruce
D274,709 S 7/1984 Bulgari
D278,987 S 5/1985 Zauderer
D279,082 S 6/1985 Bulgari
D279,874 S 7/1985 Moon
D279,875 S 7/1985 Moon
D279,876 S 7/1985 Moon
D279,877 S 7/1985 Moon
D279,878 S 7/1985 Moon
D279,879 S 7/1985 Moon
D279,880 S 7/1985 Moon
D279,881 S 7/1985 Moon
D279,882 S 7/1985 Moon
D279,883 S 7/1985 Moon
D279,884 S 7/1985 Moon
D279,885 S 7/1985 Moon
4,538,429 A 9/1985 Bradford
D281,149 S 10/1985 Krogh
D281,767 S 12/1985 Mason
D282,647 S 2/1986 Bulgari
D283,205 S 4/1986 Stephenson
D284,952 S 8/1986 Ricks
D286,758 S 11/1986 Bulgari
D287,230 S 12/1986 Bulgari
D287,231 S 12/1986 Copeland
D287,577 S 1/1987 Lorberfeld
D290,446 S 6/1987 Bulgari
4,688,400 A 8/1987 Chioffe
D292,501 S 10/1987 Jones
D292,560 S 11/1987 Di Maria et al.
D292,685 S 11/1987 Bulgari
D292,686 S 11/1987 Bulgari
D292,687 S 11/1987 Pesonen
D292,780 S 11/1987 Galask
D293,899 S 1/1988 Bulgari
D294,473 S 3/1988 Bulgari
D294,684 S 3/1988 Saraga
D295,151 S 4/1988 Saraga
D295,267 S 4/1988 Saraga
D298,611 S 11/1988 Saraga
D301,120 S 5/1989 Alviti
D301,314 S 5/1989 Shapiro
D301,561 S 6/1989 Westmoland
D301,562 S 6/1989 Gaskill
D302,252 S 7/1989 Sykes
D302,400 S 7/1989 Bulgari
D302,401 S 7/1989 Weingast
D303,230 S 9/1989 Westmoland
D303,999 S 10/1989 Hansson
D304,433 S 11/1989 McConnell, Jr.
D304,532 S 11/1989 Campbell
D304,533 S 11/1989 Campbell
D305,311 S 1/1990 Roberts
D305,996 S 2/1990 Bulgari
D307,989 S 5/1990 Stewart
D308,027 S 5/1990 Bulgari
D308,179 S 5/1990 Perlmutter et al.
D308,180 S 5/1990 Bulgari
D308,348 S 6/1990 Leopoldi
D308,349 S 6/1990 Bulgari
D308,650 S 6/1990 Bulgari
D308,651 S 6/1990 Bulgari
D308,652 S 6/1990 Bulgari
D308,838 S 6/1990 Bulgari
D308,949 S 7/1990 Bulgari
D308,950 S 7/1990 Greenhouse
D309,879 S 8/1990 Bulgari

(56) References Cited

U.S. PATENT DOCUMENTS

D310,926 S 10/1990 Bass et al.
D310,979 S 10/1990 Perry
D311,502 S 10/1990 Bulgari
D313,202 S 12/1990 Bulgari
D313,370 S 1/1991 Steiner
D315,211 S 3/1991 Reil
D315,248 S 3/1991 Marshall
D315,654 S 3/1991 Hummel
D317,095 S 5/1991 Albers et al.
D317,422 S 6/1991 Hardy
D318,197 S 7/1991 Butler
D319,801 S 9/1991 Bulgari
D320,573 S 10/1991 Bulgari
D320,798 S 10/1991 Holt
D320,799 S 10/1991 Holt
D320,951 S 10/1991 Bulgari
D321,149 S 10/1991 Royer
D321,150 S 10/1991 Bulgari
D322,890 S 1/1992 Drews
D324,350 S 3/1992 Owens, Jr.
D324,871 S 3/1992 Cordet et al.
D325,542 S 4/1992 Rubin et al.
D325,543 S 4/1992 Gueit
D326,066 S 5/1992 Sprague
D326,429 S 5/1992 Azrielant
D326,430 S 5/1992 Ortega
D326,595 S 6/1992 Badgerow et al.
D326,828 S 6/1992 Bulgari
D327,030 S 6/1992 Young
D327,850 S 7/1992 Reil
D327,982 S 7/1992 Williams
D329,341 S 9/1992 Rhodes
D329,565 S 9/1992 Kane et al.
D330,872 S 11/1992 Ball
5,161,391 A 11/1992 Lorberfeld
D331,891 S 12/1992 Foley
D332,025 S 12/1992 Caldwell et al.
D333,279 S 2/1993 Fryklund
D334,003 S 3/1993 Vogelsang
D334,004 S 3/1993 Mandelbaum
D334,010 S 3/1993 Mandelbaum
D334,153 S 3/1993 Mandelbaum
D334,353 S 3/1993 Lorberfeld
D334,855 S 4/1993 Harrington et al.
D335,959 S 6/1993 Blake
D335,995 S 6/1993 Soles
D336,574 S 6/1993 Rhodes
D336,621 S 6/1993 Vogelsang
D337,741 S 7/1993 Garfolo
D337,910 S 8/1993 Paluba
D337,963 S 8/1993 Gladorisi
D338,117 S 8/1993 Caldwell et al.
D339,310 S 9/1993 Azrielant
D342,691 S 12/1993 Milgrom
D342,894 S 1/1994 DiDomenico
D343,535 S 1/1994 Scott
D343,749 S 2/1994 Thompson
D344,910 S 3/1994 Nelson
D345,051 S 3/1994 Wills
D346,343 S 4/1994 Haugh
D347,801 S 6/1994 Church
D348,023 S 6/1994 Horner et al.
D348,854 S 7/1994 Salsgiver
D348,997 S 7/1994 Menner
D350,027 S 8/1994 Downes et al.
D352,190 S 11/1994 Tucker
5,363,675 A 11/1994 Carter
D353,120 S 12/1994 Pandel
D353,501 S 12/1994 Kral
D354,016 S 1/1995 Schubert
D354,927 S 1/1995 Andrau
D356,751 S 3/1995 Gross et al.
D358,067 S 5/1995 Graves
D358,210 S 5/1995 Reil
D359,254 S 6/1995 Gross et al.
D359,705 S 6/1995 Ball
D359,706 S 6/1995 DeAngelis
D361,451 S 8/1995 Reiland
D362,821 S 10/1995 Marchessault
D363,218 S 10/1995 Mann
D363,602 S 10/1995 Asher
D363,683 S 10/1995 Spurgeon et al.
D365,779 S 1/1996 Archambeault
D366,729 S 1/1996 Reil
D367,384 S 2/1996 DiFranco et al.
D368,671 S 4/1996 Ross
D370,372 S 6/1996 Kraft
D370,866 S 6/1996 Lange
D371,754 S 7/1996 Dunham
D371,982 S 7/1996 Price
D372,312 S 7/1996 Lange
D372,380 S 8/1996 Montalbo et al.
D373,742 S 9/1996 Janice
D374,637 S 10/1996 Esser
D374,837 S 10/1996 Austin
D375,703 S 11/1996 Lowe et al.
D376,335 S 12/1996 Shechter
D376,476 S 12/1996 Tepen et al.
D376,768 S 12/1996 Ross
5,588,309 A 12/1996 Chioffe
D377,461 S 1/1997 Kloppenburg, Jr. et al.
D378,360 S 3/1997 Montaquila
D378,808 S 4/1997 Shechter
D379,305 S 5/1997 VanFleet
D379,601 S 6/1997 Itzkowitz
D380,978 S 7/1997 Matye
D381,925 S 8/1997 Bergannini
5,660,061 A 8/1997 Magida
D383,699 S 9/1997 Bulgari
D383,700 S 9/1997 Bulgari
D383,706 S 9/1997 Archambault
D383,998 S 9/1997 Condron
D385,814 S 11/1997 Kilpatrick
D386,108 S 11/1997 Montaquila
D386,439 S 11/1997 Itzkowitz
D386,711 S 11/1997 Matye
D388,011 S 12/1997 Leonard
D388,012 S 12/1997 Matye
D388,013 S 12/1997 Rich
D388,357 S 12/1997 Montaquila
D388,734 S 1/1998 Montaquila
D388,735 S 1/1998 Webber
D389,085 S 1/1998 Montaquila
D389,424 S 1/1998 Montaquila
D389,775 S 1/1998 Bulgari
D389,776 S 1/1998 Montaquila
D390,151 S 2/1998 Blum et al.
D390,802 S 2/1998 Bulgari
D391,516 S 3/1998 Kothari
D391,756 S 3/1998 Horne
D391,887 S 3/1998 Barr
D391,888 S 3/1998 Fox
D392,041 S 3/1998 Reil
D392,042 S 3/1998 Reil
D392,206 S 3/1998 Kothari
D393,604 S 4/1998 Webber
D393,812 S 4/1998 Silveri
D394,021 S 5/1998 Matye
D394,769 S 6/1998 Flint
D394,821 S 6/1998 Montaquila
D394,823 S 6/1998 Vos
D398,875 S 9/1998 Kothari
D398,876 S 9/1998 Kothari
D401,182 S 11/1998 Bulgari
D401,486 S 11/1998 Becker
D401,884 S 12/1998 Gruosi
D406,544 S 3/1999 Leonard
D407,344 S 3/1999 Dubnicka
D408,315 S 4/1999 Lavalais
D408,317 S 4/1999 Karmeli
D410,589 S 6/1999 Lagergren
D413,830 S 9/1999 Moten
D415,446 S 10/1999 Kattan
D417,636 S 12/1999 Ambar

(56) References Cited

U.S. PATENT DOCUMENTS

D418,079 S 12/1999 Porcell
D419,908 S 2/2000 Leonard
D420,304 S 2/2000 Porcell
D420,934 S 2/2000 Montaquila
6,026,659 A * 2/2000 Kaping, Jr. ..... A44C 15/0035 63/29.1
D423,979 S 5/2000 Montaquila
D424,468 S 5/2000 Bergagnini
D424,695 S 5/2000 Reil
D427,540 S 7/2000 Calvani
D429,658 S 8/2000 Biagi
6,105,392 A 8/2000 Biagi
D430,815 S 9/2000 Montaquila
D434,877 S 12/2000 Harral
D435,476 S 12/2000 Gruosi
D436,727 S 1/2001 Hsu
D439,190 S 3/2001 Itzkowitz
D439,193 S 3/2001 Gruosi
D441,313 S 5/2001 Turner
D450,615 S 11/2001 Ambar
D454,810 S 3/2002 Knee
D455,974 S 4/2002 Torres
D458,182 S 6/2002 Gruosi
D461,409 S 8/2002 Kardush
D468,494 S 1/2003 Holloway
D472,497 S 4/2003 Bonnet
D474,353 S 5/2003 Gist Skinner
D479,145 S 9/2003 Newman
D481,326 S 10/2003 Bonifacio
D481,646 S 11/2003 Bonifacio
D484,822 S 1/2004 Crova
D485,203 S 1/2004 Pachachi
D485,204 S 1/2004 Sandberg
D486,091 S 2/2004 Pachachi
D486,416 S 2/2004 Pachachi
D487,408 S 3/2004 Coin
D489,639 S 5/2004 Castle
D506,406 S 6/2005 Sandberg
D507,985 S 8/2005 Sandberg
D511,310 S 11/2005 Gruosi
D513,392 S 1/2006 Arbore
D515,452 S 2/2006 Arbore
D516,453 S 3/2006 Kayamori et al.
D520,897 S 5/2006 Sandberg
D531,078 S 10/2006 Chan
D533,803 S 12/2006 Corso
D535,580 S 1/2007 Arbore
D537,377 S 2/2007 Becker
D537,750 S 3/2007 Allin
D537,751 S 3/2007 Becker
D538,195 S 3/2007 Williams
D538,701 S 3/2007 Williams
D539,690 S 4/2007 Allin
D540,212 S 4/2007 Becker
D541,694 S 5/2007 Ping
D542,170 S 5/2007 Bruno et al.
D542,696 S 5/2007 Cilluffo
7,217,014 B2 5/2007 Nielson
D544,389 S 6/2007 Ooten
D545,716 S 7/2007 Bulgari
D549,125 S 8/2007 Malone
D549,607 S 8/2007 Mouclier
D550,583 S 9/2007 Karachi-Langane
D554,020 S 10/2007 Bruno et al.
D555,030 S 11/2007 Hardy
D556,620 S 12/2007 Chan
D562,718 S 2/2008 Wong
D567,132 S 4/2008 Bulgari
D567,133 S 4/2008 Crawford
D567,134 S 4/2008 Bulgari
D567,702 S 4/2008 Walters
D574,745 S 8/2008 Nolan
D574,746 S 8/2008 Nolan
D588,490 S 3/2009 Momjian
D591,192 S 4/2009 Nolan
D592,538 S 5/2009 Momjian
D599,694 S 9/2009 Nolan
D599,695 S 9/2009 Nolan
D600,586 S 9/2009 Nolan
D601,056 S 9/2009 Atallah
D601,917 S 10/2009 Nolan et al.
D603,289 S 11/2009 Lebail
D605,968 S 12/2009 Colombani
D605,970 S 12/2009 Colombani
D606,443 S 12/2009 Traglio
D606,896 S 12/2009 Traglio
D607,363 S 1/2010 Traglio
D607,364 S 1/2010 Marks
D608,239 S 1/2010 McCarty-O'Brien
D610,033 S 2/2010 Colombani
D610,934 S 3/2010 Papadimitriou
D610,935 S 3/2010 Papadimitriou
D614,073 S 4/2010 Cabarbaye
D619,030 S 7/2010 Papadimitriou
D619,488 S 7/2010 Gruosi
D620,833 S 8/2010 Papadimitriou
D621,279 S 8/2010 Janssen
D621,281 S 8/2010 Janssen
D621,721 S 8/2010 Walker-Spry
D623,081 S 9/2010 Papadimitriou
D624,843 S 10/2010 Colombani
D626,881 S 11/2010 Meneau
D627,252 S 11/2010 Warren
D627,253 S 11/2010 Meneau
D628,113 S 11/2010 Papadimitriou
D628,114 S 11/2010 Papadimitriou
D629,325 S 12/2010 Papadimitriou
D630,965 S 1/2011 Papadimitriou
D630,967 S 1/2011 Lebail
D631,383 S 1/2011 Papadimitriou
D631,384 S 1/2011 Papadimitriou
D631,385 S 1/2011 Lebail
D632,605 S 2/2011 Marchand
D634,214 S 3/2011 Janssen
D635,608 S 4/2011 Gray
D636,696 S 4/2011 Lebail
D637,103 S 5/2011 Lebail
D637,104 S 5/2011 Papadimitriou
D639,692 S 6/2011 Papadimitriou
D639,694 S 6/2011 Papadimitriou
D640,585 S 6/2011 Nolan
D642,086 S 7/2011 Modi
7,980,095 B1 7/2011 Masterson
D647,421 S 10/2011 Nolan
D648,242 S 11/2011 Hara
D653,151 S 1/2012 Bennett
D655,193 S 3/2012 Janssen
D658,090 S 4/2012 Papadimitriou
D658,529 S 5/2012 Papadimitriou
D658,530 S 5/2012 Papadimitriou
D659,583 S 5/2012 Papadimitriou
D660,743 S 5/2012 Crafton
D660,744 S 5/2012 Papadimitriou
D660,745 S 5/2012 Papadimitriou
D661,219 S 6/2012 Papadimitriou
D662,005 S 6/2012 Bennett
D664,061 S 7/2012 Papadimitriou
D664,062 S 7/2012 Papadimitriou
D665,297 S 8/2012 Parris
D665,298 S 8/2012 Papadimitriou
D665,693 S 8/2012 Bennett
D668,986 S 10/2012 Friedman
D669,386 S 10/2012 Papadimitriou
D669,387 S 10/2012 Kwon
D670,191 S 11/2012 Bennett
D671,439 S 11/2012 Bennett
D672,681 S 12/2012 Bennett
D673,070 S 12/2012 Papadimitriou
D674,719 S 1/2013 Bennett
D674,720 S 1/2013 Bennett
D676,349 S 2/2013 Papadimitriou
D678,101 S 3/2013 Parvex
D680,024 S 4/2013 Le Bail
D684,085 S 6/2013 Papadimitriou

(56) References Cited

U.S. PATENT DOCUMENTS

| | | | |
|---|---|---|---|
| D689,392 | S | 9/2013 | Parvex |
| D692,261 | S | 10/2013 | Sharp |
| D692,342 | S | 10/2013 | Bennett |
| D693,260 | S | 11/2013 | Papadimitriou |
| D693,721 | S | 11/2013 | Papadimitriou |
| D694,146 | S | 11/2013 | Beeson |
| D703,084 | S | 4/2014 | Parvex |
| D707,151 | S | 6/2014 | Kimbrough et al. |
| D707,152 | S | 6/2014 | Shields |
| D708,540 | S | 7/2014 | Norendzayan |
| D708,541 | S | 7/2014 | Norendzayan |
| D709,792 | S | 7/2014 | Singer et al. |
| 8,763,357 | B1 | 7/2014 | Arnone |
| D714,673 | S | 10/2014 | Bradley |
| D716,685 | S | 11/2014 | Oh |
| D718,649 | S | 12/2014 | Harel-Klein et al. |
| D718,650 | S | 12/2014 | Weems |
| D720,647 | S | 1/2015 | Kwon |
| D722,907 | S | 2/2015 | Miceli |
| D726,577 | S | 4/2015 | Weems |
| D727,773 | S | 4/2015 | Kwon |
| D727,774 | S | 4/2015 | Kwon |
| D727,775 | S | 4/2015 | Yatsugi-Kang |
| D727,776 | S | 4/2015 | Weems |
| D727,778 | S | 4/2015 | Levinson et al. |
| D728,410 | S | 5/2015 | Yatsugi-Kang |
| D729,107 | S | 5/2015 | Riviere |
| D729,108 | S | 5/2015 | Kwon |
| D731,347 | S | 6/2015 | Zeuner |
| D733,574 | S | 7/2015 | Walker-Spry |
| D737,717 | S | 9/2015 | Weems |
| D738,774 | S | 9/2015 | Vartanian |
| D738,775 | S | 9/2015 | Vartanian |
| D740,153 | S | 10/2015 | Vartanian |
| D740,154 | S | 10/2015 | Vartanian |
| D742,779 | S | 11/2015 | Traglio |
| D743,293 | S | 11/2015 | Weems |
| D746,719 | S | 1/2016 | Weems |
| D747,665 | S | 1/2016 | Hooper |
| D747,666 | S | 1/2016 | Yatsugi-Kang |
| D748,003 | S | 1/2016 | Vartanian |
| D748,004 | S | 1/2016 | Vartanian |
| D748,005 | S | 1/2016 | Vartanian |
| D748,006 | S | 1/2016 | Vartanian |
| D748,522 | S | 2/2016 | Vartanian |
| D748,524 | S | 2/2016 | Vartanian |
| D748,525 | S | 2/2016 | Tatsugi-Kang |
| D749,456 | S | 2/2016 | Gruosi |
| D749,978 | S | 2/2016 | Holubar |
| D749,981 | S | 2/2016 | Vartanian |
| D751,451 | S | 3/2016 | Kwon |
| D752,472 | S | 3/2016 | Riviere |
| D753,012 | S | 4/2016 | Yatsugi-Kang |
| D753,015 | S | 4/2016 | Crafton et al. |
| D753,533 | S | 4/2016 | Roth |
| D758,911 | S | 6/2016 | Kwon |
| D760,110 | S | 6/2016 | Miller |
| D760,618 | S | 7/2016 | Yatsugi-Kang |
| D761,658 | S | 7/2016 | Walker-Spry |
| D763,720 | S | 8/2016 | Yatsugi-Kang |
| D764,342 | S | 8/2016 | Bulgari |
| D764,343 | S | 8/2016 | Bulgari |
| D772,099 | S | 11/2016 | Roth |
| D778,200 | S | 2/2017 | Iacomucci |
| D780,034 | S | 2/2017 | Kwon |
| D780,036 | S | 2/2017 | Silvestri |
| D780,037 | S | 2/2017 | Magallanes-Leal |
| D780,038 | S | 2/2017 | Riviere |
| D780,039 | S | 2/2017 | Abdourahim |
| D780,040 | S | 2/2017 | Galli |
| D781,739 | S | 3/2017 | Nickels |
| D782,934 | S | 4/2017 | Riviere |
| D783,442 | S | 4/2017 | Yatsugi-Kang |
| D784,846 | S | 4/2017 | Abdourahim |
| D785,491 | S | 5/2017 | Yatsugi-Kang |
| D789,826 | S | 6/2017 | Riviere |
| D792,266 | S | 7/2017 | Hardy |
| D792,803 | S | 7/2017 | Abdourahim |
| D796,372 | S | 9/2017 | Gruosi |
| D797,599 | S | 9/2017 | Yatsugi-Kang |
| D800,012 | S | 10/2017 | Oliner-Katz |
| D807,774 | S | 1/2018 | Hardy |
| D808,851 | S | 1/2018 | Kwon |
| D809,419 | S | 2/2018 | Hardy |
| D809,960 | S | 2/2018 | Marchand |
| D809,961 | S | 2/2018 | Magallanes-Leal |
| D809,962 | S | 2/2018 | Le Bail |
| D810,612 | S | 2/2018 | Corey et al. |
| D811,928 | S | 3/2018 | Stern |
| D812,510 | S | 3/2018 | Levy |
| D813,080 | S | 3/2018 | Sallard |
| D813,708 | S | 3/2018 | Lane |
| D813,709 | S | 3/2018 | Dholakiya |
| D814,291 | S | 4/2018 | Taylor |
| D815,556 | S | 4/2018 | Stern |
| D816,538 | S | 5/2018 | Nickels |
| D818,867 | S | 5/2018 | Heller |
| D820,145 | S | 6/2018 | Galli |
| D822,531 | S | 7/2018 | Stern |
| D822,532 | S | 7/2018 | Stern |
| D824,276 | S | 7/2018 | Blootacker |
| D824,277 | S | 7/2018 | Sallard |
| D826,080 | S | 8/2018 | Gentile et al. |
| D834,988 | S | 12/2018 | Silvestri |
| D836,018 | S | 12/2018 | An |
| D842,753 | S | 3/2019 | Morin |
| D846,423 | S | 4/2019 | Buccellati |
| D847,683 | S | 5/2019 | Buccellati |
| D851,532 | S | 6/2019 | Yamada |
| D852,079 | S | 6/2019 | Sivriere |
| D878,958 | S | 3/2020 | Tashjian |
| 2008/0022720 | A1 | 1/2008 | Ciccone |
| 2010/0212356 | A1 | 8/2010 | Namiki |
| 2011/0083471 | A1 | 4/2011 | Chough |
| 2013/0055758 | A1 | 3/2013 | Carter et al. |
| 2013/0186134 | A1 | 7/2013 | Goldstein |
| 2014/0150496 | A1 | 6/2014 | Briggs-Jenkins |
| 2017/0079388 | A1 | 3/2017 | Kita |
| 2018/0343990 | A1 | 12/2018 | Repossi |
| 2019/0174884 | A1 | 6/2019 | Todorova |

FOREIGN PATENT DOCUMENTS

| | | |
|---|---|---|
| JP | 2003235618 | 8/2003 |
| TW | M567017 U | 9/2018 |

OTHER PUBLICATIONS

Amethyst Triple Marquise Stud Earrings, Curated Los Angeles, https://www.curated-losangeles.com/products/amethyst-triple-marguise-stud-earriings downloaded from Internet Nov. 2020 (1 page).

Blue Buddha Boutique, Cre8time Movement: Jewelry Project in 8 steps of Less—Coiled Earrings, http://www.bluebuddhaboutique.com/blog/2013/04/cre8time-movement-jewelry-project-in-8-steps-or-less-coiled-earrings/, Apr. 6, 2013 (6 pages).

BVLA Rose Gold Mini Kandy, Mercari, https://www.mercari.com/us/item/m42882037488/?ref=brand detail_downloaded from Internet Nov. 2020 (1 page).

Casasconil.info Chandelier, Glass Crystal Chandelier Drops, Jul. 28, 2018 (54 pages).

Crafty Blog Stalker, How to Make Crystal Drop Earrings, https://thecraftyblogstalker.com/diy-rhinestone-drop-earrings/, last updated Jun. 17, 2019 (12 pages).

Crystal Dangle Hoop Earrings 925 Sterling Silver Dianty Dangling Charms Cubic Zirconia Small Huggie Round Hoops 10mm Delicate Jewelry for Women Girls Birthday Gifts: Clothing, Amazon.com, https://www.amazon.com/Earrings-Sterling-Dangling-Zirconia-Delicate/dp/B0895FB6QX downloaded from Internet Nov. 2020 (1 page).

CZ Marquise Dangle screw flat back cartilage stud, helix earring, Etsy, https://www.etsy.com/listing/777314953/cz-marquise-s-dangle-

(56) References Cited

OTHER PUBLICATIONS screw-fiat-back?ga_order=most_relevant&ga_search_type=all&ga_view_type=gallery&ga_search_query=triple+marguise+stud&ref=sr_gallery-1-8&pro=1 downloaded from Internet Nov. 2020 (1 page).
Dangling Gemstone Earring 925 Solid Sterling Silver Rose Gold, Etsy, https://www.etsy.com/listing/851972585/dangling-gemstone-earring-925-solid?ga_order-most_relevant&ga_search_type=all&ga_view_type=gallery&ga_search_query=MARIA+TASH&ref=sr_gallery-1-1&organic_search_click=1&frs=1&col=1 downloaded from Internet Nov. 2020 (1 page).
Djula, Gold and Diamond Multi tassel hoop piercing, https://www.djula.fr/en/piercings/567-multi-tassel-hoop-piercing.html downloaded from Internet Nov. 2020 (1 page).
Free People, 6.5mm Gold Tassel Eternity Single Earring, https://www.freepeople.com/shop/65mm-gold-tassel-eternityingle-earring/. Retreived USPTO Examiner Aug. 31, 2019.
Fringe Hoop Earrings for Sale at Auction on Tue, Feb. 22, 2011—07:00—Pair of White Gold, Blue Topaz, Pink Tourmaline and Diamond Earrings, Fine Jewelry and Contents of Abandoned Safe Deposit Boxes from Bank of America, Doyle Auction House, https://doyle.com/auctions/11jl01-fine-jewelry-and-contents-of-abandoned-safe-deposit-boxes-from-b_ank-of-america-148 downloaded from Internet Nov. 2020 (1 page).
International Search Report and Written Opinion dated Mar. 31, 2021 for International Application PCT/US20/64189 filed Dec. 10, 2020 (11 pages).
International Search Report and Written Opinion dated Mar. 18, 2021 for International Application PCT/US20/63231 filed Dec. 4, 2020 (13 pages).
Luxury Exaggeration Big Round Pearl Hoop Earrings for Women Boho Geometric Large Statement Hanging Earrings 2019 Fashion Jewelry Hoop Earrings—AliExpress, https://www.aliexpress.com/item/33011429560.html?spm=a2g0o.productlist.0.0.8bt2647ds4vMa6&algo_pvid-9ea83007-0e57-451b-9bca-bcdedcd898d7&algo_expid=9es83007-0657-451b-9bca-bcdedcd698d7-30&btsid=0bb0622f16033748731547472ee84d&ws_ab_test=searchweb0_0.searchweb201602_,searchweb201603 downloaded from Internet Nov. 2020 (1 page).
Maria Tash 14g 8mm Single Chain Septum Spinner, https://www.mariatash.com/14g-8mm-single-chain-septum-spinner.html#; downloaded from Internet Aug. 31, 2020 (1 page).
Maria Tash 16mm Diamond In-Set Lotus Coronet Hoops Pair, https://www.mariatash.com/16mm-diamend-inet-lotcoronet-hoops-pair.html?metal=White%20Gold. Retrieved by USPTO Exmier Sep. 9, 2019.
Maria Tash 3mm Diamond Engraved Lotus Threaded Stud, https://www.mariatash.com/jewelry/helix-jewelry/3mm-diamond-engraved-lotus-threaded-stud.html# downloaded from Internet Nov. 2020 (1 page).
Maria Tash 6.5mm Diamond Eternity Ring and Two Cuffs, https://www.mariatash.com/jewelry/earlobe/diamond-1-4-triple-eternity.ringnd-two-cuffs-earlobe.htm?metal=White%20Gold. USPTO Examiner Sep. 9, 2019.
Maria Tash 6.5mm Diamond Tassel Eternity Ring, htips://www.mariatash.com/jewelry/earlobe/1-4-diamond-tassel-eternity-ring.html?metal=White20Gold Retrieved Aug. 31, 2019.
Maria Tash Black Rainbow Sapphire 14k Yellow Gold, eBay, https://www.ebay.com/itm/14k-Yellow-Gold-Maria-Black-Rainbow-Sapphire-Nwt-358-Vry-Maria-Tash-TLL/293780593993?hash=item4466b01649:g:JP4AAOSwZRNfLe?Z downloaded from Internet Nov. 2020 (1 page).
Maria Tash Brand, Amato Fine Jewelry, https://www.amatopiercing.com/brand/maria-tash/ downloaded from Internet Nov. 2020 (1 page).
Maria Tash Brand, ShopoTam, Ebay, http://shopotam.ru/brand/maria-tash/ downloaded from Internet Nov. 2020 (1 page).
Maria Tash Coronet Earrings, Cheaponline, https://ar.cheaponline2020.net/category?name=coronet%20earrings downloaded from Internet Nov. 2020 (1 page).
Maria Tash Diamond and Chain Orbit Joining Earring White Gold 2mm, PicClick UK, https://picclick.co.uk/Maria-Tash-White-Gold-2mm-Diamond-and-Chain-174458974872.html downloaded from Internet Nov. 2020 (1 page).
Maria Tash Diamond Butterfly, RisingBastards, https://risingbastards.com/2020/10/20/diamond-butterfly-maria-tash/ downloaded from Internet Nov. 2020 (1 page).
Maria Tash Diamond Delia and Marquise Dangle Chain Orbital, https://www.mariatash.com/jewelry/earobe/diamond-delia-marquisend-rounds-chainnd-dangles-orbital.html?metal=Rose%20Gold.
Maria Tash Diamond Eternity Ring and Cuff, https://modesens.com/product/maria-tash-diamond-eternity-ringnd-cuff-18kt-rose-goldingle-earring-pink-5724852/ Retrived by USPTO Exminer Sep. 9, 2019.
Maria Tash Diamond Princess Ring 2mm White Gold, https://rootip.rosendalehistorical.org/index.php?main page=product info&products_id=11835 downloaded from Internet Nov. 2020 (1 page).
Maria Tash Diamond Spike Eternity Earring 18K Yellow Gold 8mm Diameter, PicClick, https://picclick.com/Maria-Tash-Diamond-Spike-Eternity-Earring-18K-Yellow-338743759231.html downloaded from Internet Nov. 2020 (1 page).
Maria Tash Double Row Gem Clicker Ring 14ct White Gold, Isha Body, https://ishabodyjewellery.co.uk/products/14ct-white-gold-elegant-clicker-ring?variant=29157947572317 downloaded from Internet Nov. 2020 (1 page).
Maria Tash Earrings, https://mariatash.com/jewelry/earlobe.html downloaded from Internet Jun. 30, 2019 (35 pages).
Maria Tash EUC Silver Tone Mirrored Compact, Poshmark, https://poshmark.com/listing/EUC-Maria-Tash-Siiver-Tone-Mirrored-Compact-514fef19e1316439C30fd481 downloaded from Internet Nov. 2020 (1 page).
Maria Tash Gold Clicker Eternity Earring Yellow Gold and Pearl Hoop, The Luxury Closet, https://theluxurycloset.com/us-en/women/maria-tash-gold-clicker-eternity-yellow-gold-and-pearl-single-hoop-earring-p288362 downloaded from Internet Nov. 2020 (1 page).
Maria Tash Gold Jewelry, Bodyartforms, https://bodyartforms.com/products.asp?brand=venus+by+maria+tash downloaded from Internet Nov. 2020 (1 page).
Maria Tash Inspired Gold Earring With Chain Ring, https://www.sekaimon.com/s/maria%20tash/-/all downloaded from Internet Nov. 2020 (1 page).
Maria Tash Invisible Diamond Lotus Close Garland Ear Climber, https://www.mariatash.com/jewelry/invisible-diamond-lotus-garland-ear-climber.html, (2 pages).
Maria Tash Jewelry, Stylight, https://www.stylight.com/Maria-Tash/Jewelry/ downloaded from Internet Nov. 2020 (1 page).
Maria Tash Navel Ring Belly Button Ring, Poshmark, https://poshmark.com/listing/Maria-Tash-navel-ring-belly-button-ring-5c7ac13c8ad2f9c803c2d159 downloaded from Internet Nov. 2020 (1 page).
Maria Tash Products, Pirate Piercing, https://shop.piratepiercing.be/ downloaded from Internet Nov. 2020 (1 page).
Maria Tash Septum Chains, Poshmark, https://poshmark.com/listing/Maria-Tash-Septum-Chains-599706fef739bc9b4401c73c downloaded from Internet Nov. 2020 (1 page).
Maria Tash Verkooppunt Vederland, Piercing Boutique, https://www.piercingboutique.nl/pages/maria-tash-verkooppunt downloaded from Internet Nov. 2020 (1 page).
Marquise Baguette Dangling Chains Wrap Stud Earrings, Etsy, https://www.etsy.com/listing/853121609/cartilage-stud-earrings-cartilage-chain=ga_order=most_relevant&amp%3Bga_search_type-all&amp%3Bga_view_type=gallery&amp%3Bga_search_query=marquise%2Bearrings&amp%3Bref=sc_gallery-2-19&amp%3Bplkey=76c432b01b045f75add569a8af782f33fe250c00%3A853121609&amp%3Bpro=a&amp%3Bcol=1 downloaded from Internet Nov. 2020 (1 page).
Marquise Chain Stud Earrings Retro 18k Gold Plated Sterling Silver CZ—Alibaba.com, https://www.alibaba.com/product-detail/18K-gold-plated-sterling-silver-CZ 1600101995122.html?spm-a2700.galleryofferlist.normal offer.d image.798a14a2lpXmMR downloaded from Internet Nov. 2020 (1 page).
Marquise CZ Flower Shaped Stud Earrings With Dangling Chain—Alibaba.com, https://www.alibaba.com/product-detail/Marquise-CZ-Flower-Shaped-Stud-Earrings_1700001431499.html?spm=a2700.

(56) References Cited

OTHER PUBLICATIONS galleryofferlist.normal_offer.d_image.798a14a2tpXmMR downloaded from Internet Nov. 2020 (1 page).
Marquise CZ Flower Stud Earrings, S925 Sterling Silver Post 14K Gold Plated Minimalist Dainty Flower Shaped Stud Earrings With Dangling Charm Marquise Studs Earrings Cartilage Earring: Jewelry, Amazon.com, https://www.amazon.com/Marquise-Earinas-Sterling-Minimalist-Cartilage/dp/B08BCQ8PMG/ref=sr_1_18?dchild=1&keywords=marquise%2Bstud%2Bearrings&qid=1603376238&sr=8-18&th=1 downloaded from Internet Nov. 2020 (1 page).
Marquise Dangle Stud Gold Earring, Adina's Jewels https://adinasjewels.com/products/marquise-dangle-stud-earring downloaded from Internet Nov. 2020 (1 page).
Marquise Diamond Simple in Style Earrings Jewelry S925 Sterling Silver—Alibaba.com, https://www.alibaba.com/product-detail/S925-sterling-silver-marquise-diamond-simple_1600118221984.html?spm=a2700.galleryofferlist.normal_offer.d_title.798a14a2pXmMR downloaded from Internet Nov. 2020 (1 page).
Marquise Shape Diamond Stud Earring, SGL Certified 0.64 Ct Diamond Flower Earring, Body Jewellery, Petal Cartilage Earring, Helix Piercing, 18K Yellow Gold Flat Screw on Back 7mm: Jewelry, Amazon.com, https://www.amazon.com/Marquise-Certified-Jewellery-Cartilage-Piercing/dp/B08JX7S7V2/ref=sr1_96?dchild=1&keywords=marquise+stud+earrings&qid=1603376238&sr=8-96 downloaded from Internet Nov. 2020 (1 page).
Marquise turquoise studs, 925 earrings, gold stud earrings, Etsy, https://www.etsy.com/listing/832205081/925-earrings-marquise-turquoise-studs?ga_order=most_relevant&ga_search_type=all&ga_view_type=gallery&ga_search_query=marquise+studs&ref=sr_gallery-2-3&pro=1 downloaded from Internet Nov. 2026 (1 page).
Minimalist Marquise CZ Flower Shaped Stud Earrings With Dangling Charm, Etsy, https://www.etsy.com/listing/740432826/minimalist-marquise-cz-flower-studs?ga_order=most_relevant&ga_search_type-all&ga_view_type=gallery&ga_search_query=marquise+studs&ref=sc_gallery-2-20&plkey=5824c downloaded from Internet Nov. 2020 (1 page).
Minimalist Marquise CZ Flower studs Dainty earrings CZ gold, Etsy, https://www.etsy.com/listing/740432826/minimalist-marquise-cz-flower-studs?ga_order=most_relevant&ga_search_type-all&ga_view_type=gallery&ga_search_query=marquise+studs&ref=sc_gallery-2-20&plkey=5824c downloaded from Internet Nov. 2020 (1 page).
Minimalist Marquise Tiny Cz Cubic Zirconia Stud Earrings Jewelry—Buy 925 Minimalist Marquise Cz Stud Earrings,925 Silver Small Tiny Earrings Jewelry,Earrings for Women Product, Alibaba.com, https://www.alibaba.com/product-detail/2020-NEW-925-Sterling-Silver-minimalist_1600125651312.html?spm=a2700.galleryofferlist.normal_offer.d_image.798a14a2tpXmMR downloaded from Internet Nov. 2020 (1 page).
Moet, Mercury Mist Threadless End, Buddha Jewelry Organics, https://www.buddhajewelryorganics.com downloaded from Internet Nov. 2020 (1 page).
Rhinestone Fringe Hoop Earrings 1 pair, SHEIN USA, https://us.shein.com/Rhinestone-Fringe-Hoop-Earrinqs-1pair-p-621973-cat-1757.html downloaded from Internet Nov. 2020 (1 page).
Rustic Diamond Marquise Three Leaf Earrings, TWISTonline, https://www.twistonline.com/collections/dangles/products/rustic-diamond-marquise-three-leaf-earrings downloaded from Internet Nov. 2020 (1 page).
Sequito Elegant Costume Jewelry Pave Purple CZ with Light Green Water Drop Tassel Drop Hoop Earrings for Women Boho Round Earing SE-190, Lazada PH, https://www.lazada.com.ph/products/sequito-elegant-costume-jewelry-pave-purple-cz-diaomd-with-light-green-water-drop-tassel-drop-hoop-earrings-for-women-boho-round-earing-se-190-I925580578.html downloaded from Internet Nov. 2020 (1 page).
Single Half Pair 18k Gold Genuine Diamond Lotus Flower, Etsy, https://www.etsy.com/listing/836784442/new-single-half-pair-18k-gold-genuine?ga_order=most_relevant&ga_search_type-all&ga_view_type=gallery&ga_search_query=MARIA+TASH&ref=sr_gallery-2-14&organic_search_click=1&pro=1&frs=1 downloaded from Internet Nov. 2020 (1 page).
Sparkly Marquise Dangle Cubic Zircon Chain Stud Gold Plated Earrings Jewelry 925 Sterling Silver—Alibaba.com, https://www.alibaba.com/product-detail/Gold-Plated-Earrings-Jewelry-925-Sterling_62451516048.html?spm=a2700.galleryofferlist.normal_offer.d_title.798a14a2tpXmMR downloaded from Internet Nov. 2020 (1 page).
Sparkly Marquise Dangle Stud Earrings, J&CO Jewellery, https://www.jcojewellery.com/collections/nature/products/sparkly-marquise-dangle-stud-earrings downloaded from Internet Nov. 2020 (1 page).
Triple Marquise CZ Leaf Helix earring Conch Earring, Etsy, https://www.etsy.com/listing/750423781/triple-marquise-cz-leaf-helix-earring?ga_order=most_relevant&ga_search_type=all&ga_view_type=gallery&ga_search_query=triple+marquise+stud&ref=sr_gallery-1-5&col=downloaded from Internet Nov. 2020 (1 page).
Umba Sapphire Baby Teardrop Fringe Hoops(18k), TalismanUnlimited.com, https://www.talismanunlimited.com/products/umba-sapphire-baby-teardrop-fringe-hoops downloaded from Internet Nov. 2020 (1 page).
Yeslady Tassel Hoop Earrings, Small CZ Rhinestone Dangle Earrings at Amazon.in, https://www.amazon.in/YESLADY-Tassel-Eanings-Rhinestone-Dangle/dp/B07QZQ14RF downloaded from Internet Nov. 2020 (1 page).
Taiwan Office Action dated Jul. 26, 2021 in related application 109142926 filed Dec. 4, 2020 (13 pages).

* cited by examiner

EARRINGS AND METHODS OF MANUFACTURE AND USE THEREOF

CROSS-REFERENCE TO RELATED PATENT APPLICATIONS

This patent application is a Continuation-in-Part of International Patent Application PCT/US2020/063231 filed 4 Dec. 2020; which claims a benefit of priority to U.S. Provisional Patent Application 62/944,888 filed 6 Dec. 2019;

This patent application is a Continuation-in-Part of U.S. Design patent application 29/725,925 filed 27 Feb. 2020;

This patent application is a Continuation-in-Part of U.S. Utility patent application Ser. No. 17/163,825 filed 1 Feb. 2021; which is a Continuation of U.S. Utility patent application Ser. No. 17/013,826, filed 7 Sep. 2020, now U.S. Pat. No. 10,905,206 issued 2 Feb. 2021; which is (1) a Continuation-in-Part of U.S. Design patent application 29/725,811 filed 27 Feb. 2020, and (2) a Continuation-in-Part of U.S. Design patent application 29/749,236 filed 3 Sep. 2020; and This patent application is a Continuation-in-Part of U.S. Design patent application 29/768,794 filed 1 Feb. 2021; which is a Continuation of U.S. Utility patent application Ser. No. 17/013,826 filed 7 Sep. 2020, now U.S. Pat. No. 10,905,206 issued 2 Feb. 2021; which is (1) a Continuation-in-Part of U.S. Design patent application 29/725,811 filed 27 Feb. 2020, and (2) a Continuation-in-Part of U.S. Design patent application 29/749,236 filed 3 Sep. 2020.

Each of the patent applications referenced above is incorporated by reference herein for all purposes.

BACKGROUND

A user may wear an earring having a frontal portion and a back portion with a post. When the frontal portion is heavy, then the post may snap, which may result in the frontal portion or the back portion falling off the user, which is not desired.

SUMMARY

In an embodiment, an earring comprises: a housing including a cavity; a post extending out of the housing from within the cavity, wherein the post is externally threaded; a tube that is internally threaded; and a base from which the tube extends, wherein the cavity is configured to receive the tube such that (a) the post extends into the tube and (b) the post and the tube thread with each other while the tube spans between the housing and the base.

In an embodiment, a method comprises: manufacturing a first piece including a housing and a post, wherein the housing includes a cavity, wherein the post extends out of the housing from within the cavity, wherein the post is externally threaded; manufacturing a second piece including a base and a tube, wherein the tube extends from the base, wherein the tube is internally threaded; causing the cavity to receive the tube such that (a) the post extends into the tube and (b) the post and the tube thread with each other while the tube spans between the housing and the base.

In an embodiment, a method comprises: causing a user to hold a first piece including a housing and a post, wherein the housing includes a cavity, wherein the post extends out of the housing from within the cavity, wherein the post is externally threaded; causing the user to hold a second piece including a base and a tube, wherein the tube extends from the base, wherein the tube is internally threaded; and causing the user to form an earring via the cavity receiving the tube such that (a) the post extends into the tube and (b) the post and the tube thread with each other while the tube spans between the housing and the base.

DETAILED DESCRIPTION OF PREFERRED EMBODIMENTS

Figure 1:
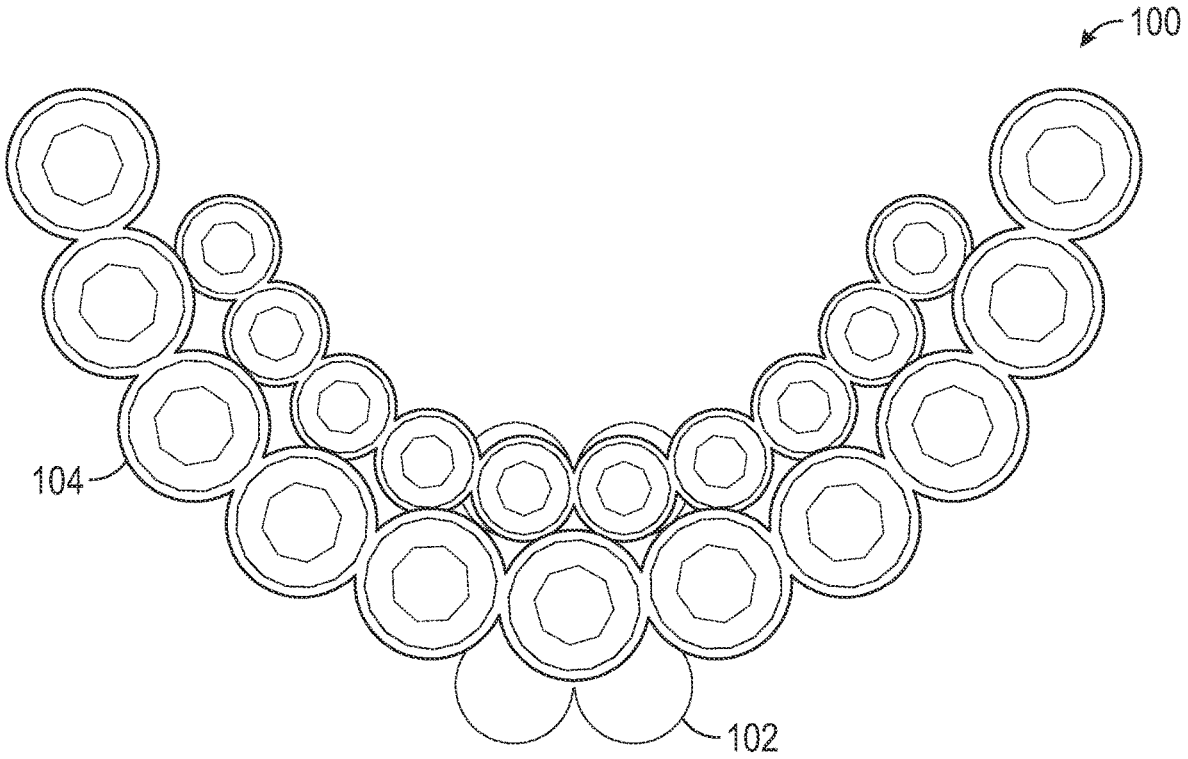
FIG. 1 shows a front view of an embodiment of an earring according to this disclosure.

Generally, this disclosure discloses various earrings, some of which can include: a housing including a cavity; a post extending out of the housing from within the cavity, where the post is externally threaded; a tube that is internally threaded; and a base from which the tube extends. The cavity is configured to receive the tube such that (a) the post extends into the tube and (b) the post and the tube thread with each other while the tube spans between the housing and the base. As such, by recessing the post within the cavity of the housing, there is an added structural integrity that enables the base to support or host a heavier decorative portion as the tube provides for additional support. However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Figure 2:
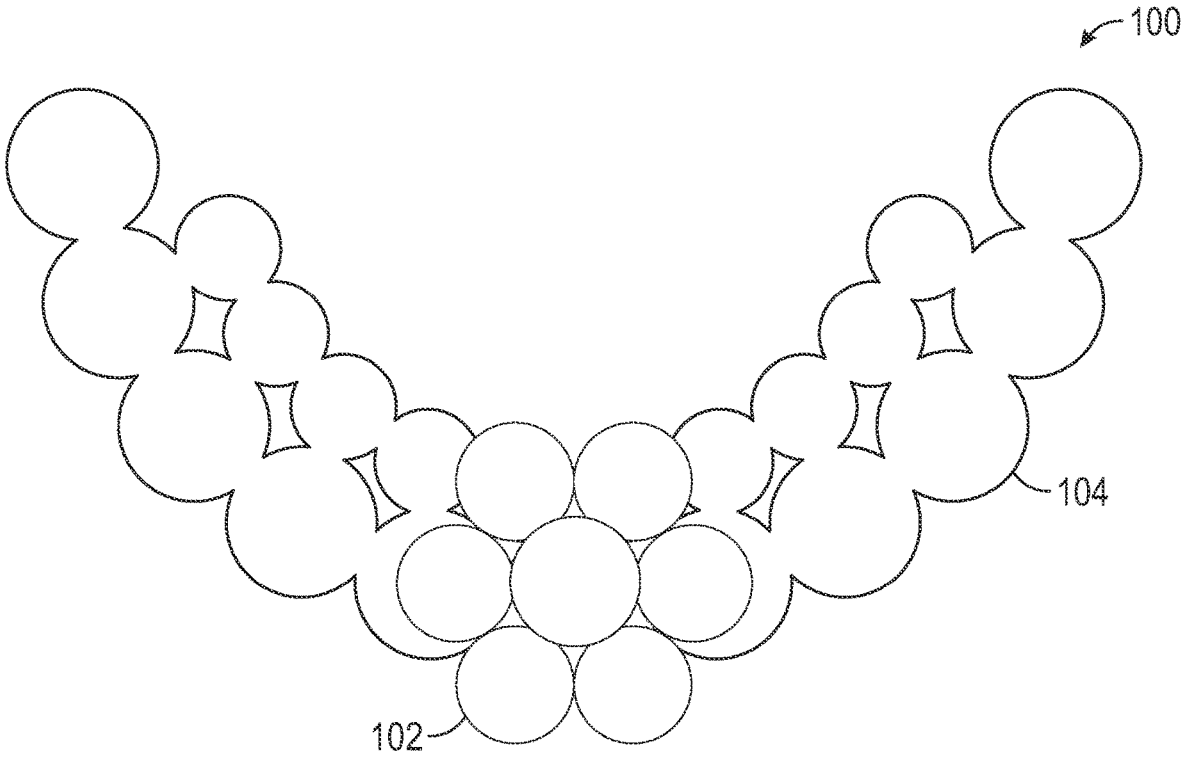
FIG. 2 shows a back view of an embodiment of an earring according to this disclosure.

FIG. 1 shows a front view of an embodiment of an earring according to this disclosure. FIG. 2 shows a back view of an embodiment of an earring according to this disclosure. In particular, an earring 100 includes a back portion 102 (backing) and a front portion 104 (face), although these can be reversed. When the earring 100 is worn on a lobe of an ear of a head of a person, then the back portion 102 faces the head or not if reversed. Likewise, when the earring 100 is worn on the lobe of the ear of the head of the person, then the front portion 104 is visible to other people or not if reversed. As such, when the earring 100 is worn on the lobe of the ear of the head of the person, then a viewer frontally looking at the ear would see the front portion 104, as shown in FIG. 1, or not if reversed. Correspondingly, when the earring 100 is worn on the lobe of the ear of the head of the person, then the viewer rearward looking at the ear would see the back portion 102, as shown in FIG. 2, or not if reversed. However, note that although the earring 100 is described in context of the lobe of the ear of head of the person, this is not limiting and other sections of the ear of the head of the person can also be used and, therefore, the earring 100 can be of different types (e.g., helix/cartilage, industrial, rook, daith, tragus, snug, conch, anti-tragus).

Figure 3:
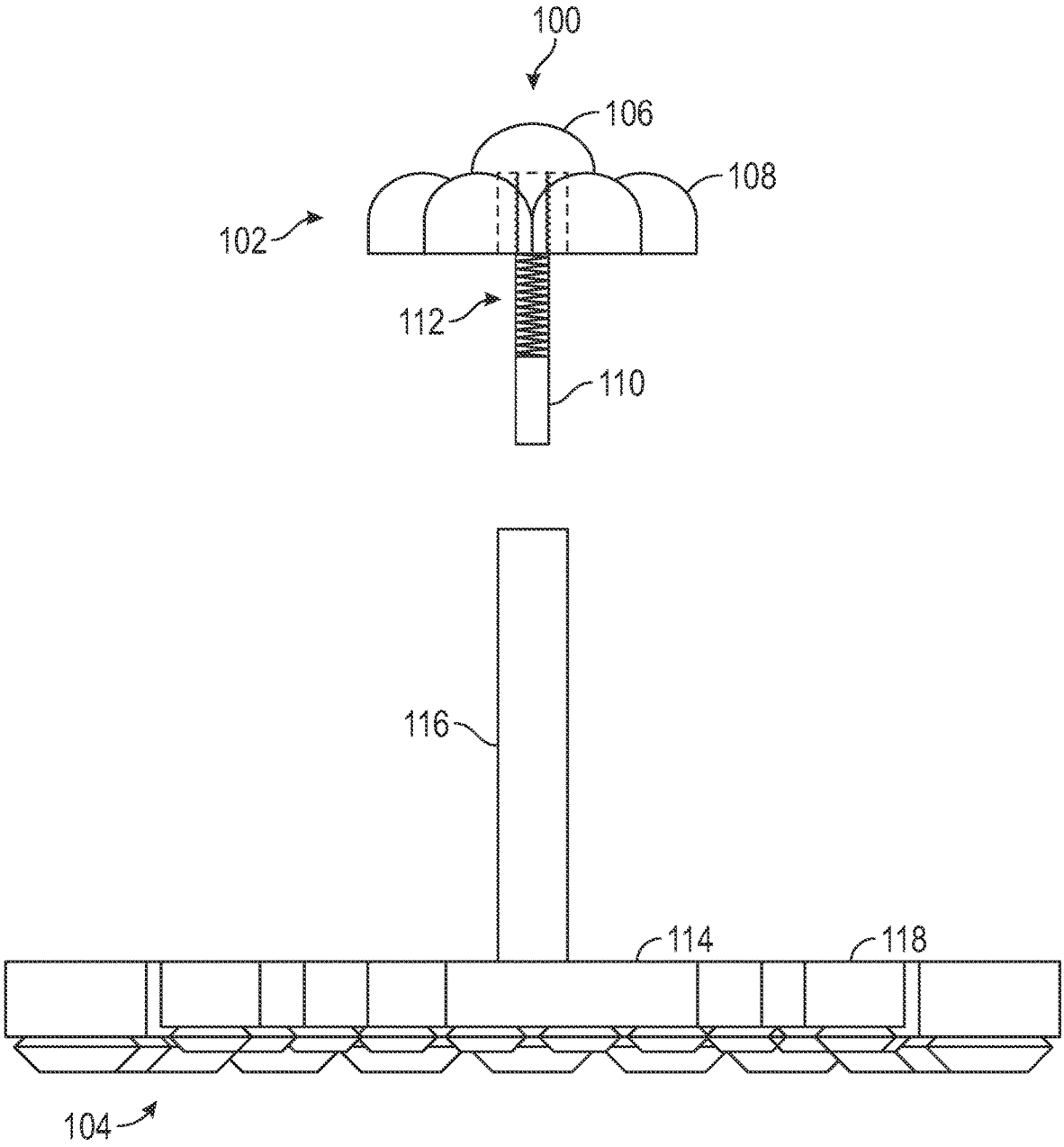
FIG. 3 shows a top view of an earring having a frontal portion and a back portion, before the frontal portion is assembled with the back portion according to this disclosure.
Figure 8:
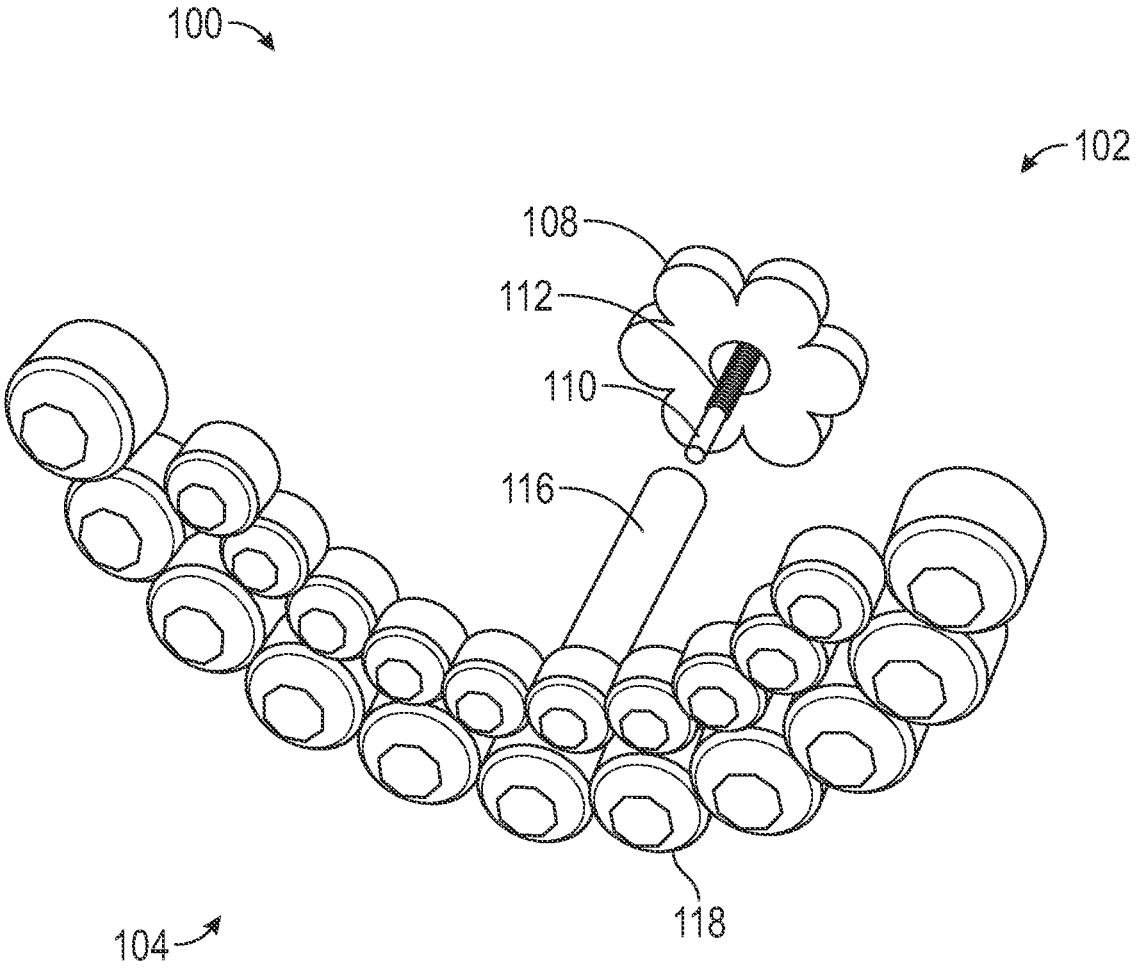
FIG. 8 shows a front perspective view of an earring having a frontal portion and a back portion, before the frontal portion is assembled with the back portion according to this disclosure.
Figure 9:
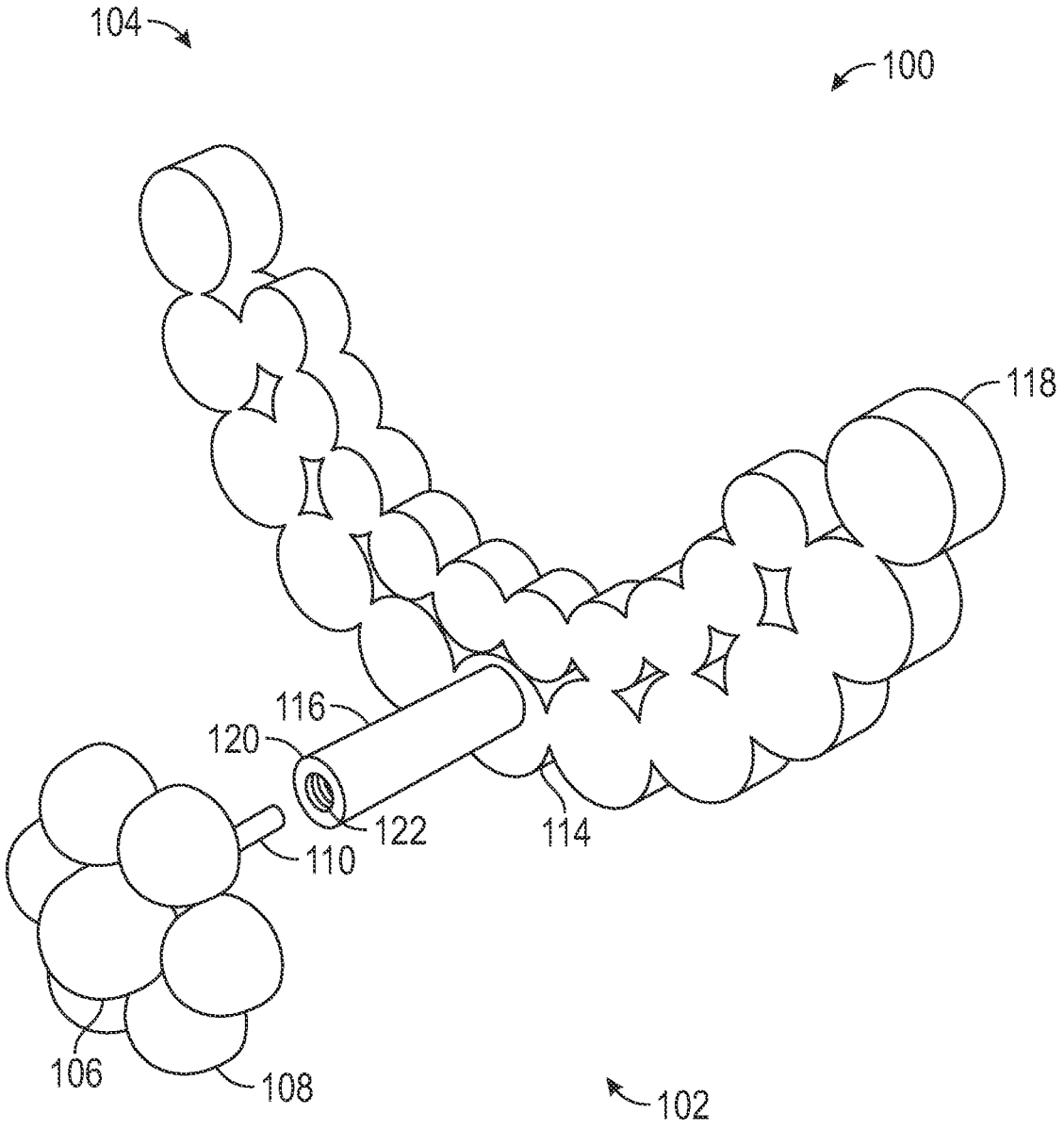
FIG. 9 shows a back perspective view of an earring having a frontal portion and a back portion, before the frontal portion is assembled with the back portion according to this disclosure.

FIG. 3 shows a top view of an earring having a frontal portion and a back portion, before the frontal portion is assembled with the back portion according to this disclosure. FIG. 8 shows a front perspective view of an earring having a frontal portion and a back portion, before the frontal portion is assembled with the back portion according to this disclosure. FIG. 9 shows a back perspective view of an earring having a frontal portion and a back portion, before the frontal portion is assembled with the back portion according to this disclosure. In particular, the earring 100 includes the back portion 102 and the front portion 104 that are separate and distinct from each other before assembly. The back portion 102 includes a housing 106, a decorative piece 108, and a post 110. The front portion 104 includes a base 114, a tube 116, and a decorative piece 118.

The housing 106 is dome-shaped, but can be shaped differently (e.g., non-dome shaped, plate, cube, cuboid, conical, pyramidal). The housing 106 includes metal (e.g., gold, silver, titanium, rare earth) or metal alloy (e.g., steel, brass, nitride, boride), but can include other materials (e.g., plastic, rubber, silicone). The housing 106 includes a cavity (e.g., cube, cuboid, conical, pyramidal) that is internal, whether volumetrically symmetrical or volumetrically asymmetrical, whether positioned centrally in the housing 106 or non-centrally in the housing 106. The housing 106 includes an opening leading to the cavity, whether the opening is positioned on the housing 106 or not centrally positioned on the housing 106, whether opening is perimetrically symmetrical or perimetrically asymmetrical. Note that although the cavity is a well, the cavity can be a through-channel thereby extending through the housing and be open on both ends as well.

The decorative piece 108 extends from or is attached to the housing 106. The decorative piece 108 can be unitary with the housing 106 (e.g., cast, molded, bonded, fused, melted) or the decorative piece 108 can be assembled with the housing 106 (e.g., adhered, magnetized, hook-and-looped, mated, fastened, interlocked). The decorative piece 108 includes metal (e.g., gold, silver, titanium, rare earth) or metal alloy (e.g., steel, brass, nitride, boride), but can include other materials (e.g., plastic, rubber, silicone). The decorative piece 108 is shown a ring of domes extending about the housing 106, but can be shaped differently (e.g., ring of non-domes, non-ring of domes, crescent, star, character). The decorative piece 108 can also be absent.

The post 110 extends out of the housing 106 from within the cavity, whether in a cantilevered manner or a non-cantilevered manner. For example, the housing 106 includes an inner surface from which the post 110 extends out of the housing 106 from within the cavity. For example, the cavity includes a floor and a sidewall (e.g., smooth surface, rough surface), where the post 110 extends from the floor and the sidewall extends about the post 110. For example, the sidewall can have a line (e.g., rigid, flexible) extending therefrom (e.g., bridging) such that the line spans between the sidewall and the post 110 and thereby supports the post 110 within the cavity such that the post 110 has at least two points of support (floor and sidewall). For example, the post 110 can also extend from the sidewall (e.g., L-shaped, J-shaped, V-shaped).

Although the post 110 and the housing 106 form a mushroom-shape, other shapes are possible (e.g., T-shape, L-shape, J-shape). The post 110 is rectilinear, but can be non-rectilinear (e.g., arcuate, sinusoidal, helical). The post 110 is internally solid, but can be internally hollow. The post 110 can be unitary with the housing 106 (e.g., cast, molded, bonded, fused, melted) or the post 110 can be assembled with the housing 106 (e.g., adhered, magnetized, hook-and-looped, mated, fastened, interlocked). For example, the post 110 can be unitary with the housing 106 and includes same material (e.g., metal, metal alloy). The post 110 includes metal (e.g., gold, silver, titanium, rare earth) or metal alloy (e.g., steel, brass, nitride, boride), but can include other materials (e.g., plastic, rubber, silicone).

The post 110 has an external surface which hosts a plurality of helical threads 112, whether continuous or discontinuous, whether right-handed or left-handed, whether male or female, whether square, triangular, trapezoidal or other forms, of any thread angle, of any type of lead, pitch, start, thread depth, or taper. The helical threads 112 can be unitary with the post 110 (e.g., cast, molded, bonded, fused, melted) or the post 110 can be assembled with the helical threads 112 (e.g., adhered, magnetized, hook-and-looped, mated, fastened, interlocked). As such, the post 110 is externally threaded. For example, as shown in FIG. 3, the post 110 has a longitudinal length, where the post 110 has the external surface extending along the longitudinal length and the external surface is not fully externally threaded along the longitudinal length. For example, the helical threads 112 can have a thread length range or a recession range about 0.0001 millimeters (mm) to about 100 mm. For example, the helical threads 112 can have a thread thickness of about 0.1 mm to about 80 mm.

The base 114 is dome-shaped, but can be shaped differently (e.g., non-dome shaped, plate, cube, cuboid, conical, pyramidal). The base 114 includes metal (e.g., gold, silver, titanium, rare earth) or metal alloy (e.g., steel, brass, nitride, boride), but can include other materials (e.g., plastic, rubber, silicone).

The decorative piece 118 extends from or is attached to the base 114. The decorative piece 118 can be unitary with the base 114 (e.g., cast, molded, bonded, fused, melted) or the decorative piece 118 can be assembled with the base 114 (e.g., adhered, magnetized, hook-and-looped, mated, fastened, interlocked). The decorative piece 118 includes metal (e.g., gold, silver, titanium, rare earth) or metal alloy (e.g., steel, brass, nitride, boride), but can include other materials (e.g., plastic, rubber, silicone). The decorative piece 118 is shown a pair of arcs of domes extending from the base 114, but can be shaped differently (e.g., ring of non-domes, non-ring of domes, crescent, star, character, single arc of domes, triple arc of domes, single non-arc of domes, triple non-arc of domes, single non-arc of non-domes, triple non-arc of non-domes). The decorative piece 118 can also be absent.

The tube 116 extends from the base 114. Although the tube 116 and the base 114 form a T-shape, other shapes are possible (e.g., L-shape, J-shape, mushroom shape). The tube 116 is rectilinear, but can be non-rectilinear (e.g., arcuate, sinusoidal, helical). The tube 116 is internally hollow, but can be internally solid and internally hollow. The tube 116 can be unitary with the base 114 (e.g., cast, molded, bonded, fused, melted) or the tube 116 can be assembled with the base 114 (e.g., adhered, magnetized, hook-and-looped, mated, fastened, interlocked). For example, the tube 116 can be unitary with the base 114 and includes same material (e.g., metal, metal alloy). The tube 116 includes metal (e.g., gold, silver, titanium, rare earth) or metal alloy (e.g., steel, brass, nitride, boride), but can include other materials (e.g., plastic, rubber, silicone).

The tube 116 includes an open end 120 distal to the base 114, a closed end proximal to the base 114, and a cavity extending between the open end 120 and the closed end and in fluid communication with the open end. The open end 120 is circular, but can be shaped differently (e.g., oval, square, octagon, pentagon, triangular). The open end 120 leads into the cavity of the tube 116. The open end 120 is sized and shaped to receive the post 110 therethrough. The cavity can extend from the open end to the closed end of the tube 116 or less than that distance (e.g., less than 9/10, 8/10, 7/10, 6/10, 5/10, 4/10, 3/10, 2/10, or 1/10 longitudinal length of tube 116) from the open end. The cavity is sized and shaped to receive the post 110 after the post 110 enters the open end 120. The tube 116 can avoid the closed end proximal to the base 114 and thereby be an open end as well, whether allowing access into the base 114 or stopping at the base 114 without access into the base 114.

The tube 116 has an inner surface defining the cavity. The inner surface hosts a plurality of helical threads 122, whether continuous or discontinuous, whether right-handed or left-handed, whether male or female, whether square, triangular, trapezoidal or other forms, of any thread angle, of any type of lead, pitch, start, thread depth, or taper. The helical threads 122 start in proximity of or from the open end 120 and extend into the tube 116. The helical threads 122 can longitudinally span the cavity from beginning to end or less than that, whether from the open end 120 or past the open end 120 or up to the closed end or before the closed end. The helical threads 122 are configured to engage with the helical threads 112 such that fastening can occur. The helical threads 122 can be unitary with the tube 116 (e.g., cast, molded, bonded, fused, melted) or the tube 116 can be assembled with the threads 122 (e.g., adhered, magnetized, hook-and-looped, mated, fastened, interlocked). As such, the tube 116 is internally threaded.

Figure 4:
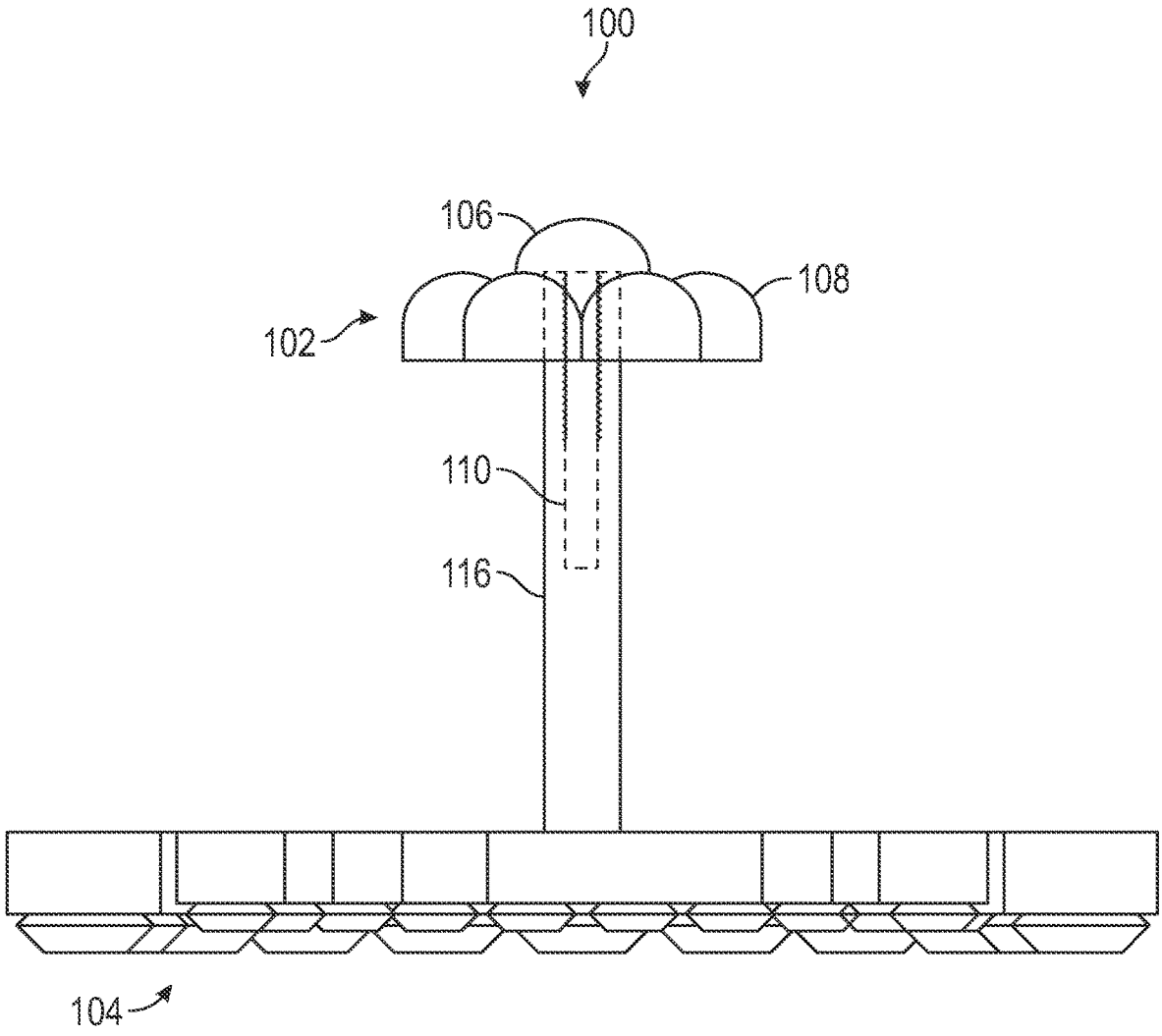
FIG. 4 shows a top schematic view of an earring having a frontal portion and a back portion, after the frontal portion is assembled with the back portion according to this disclosure.
Figure 5:
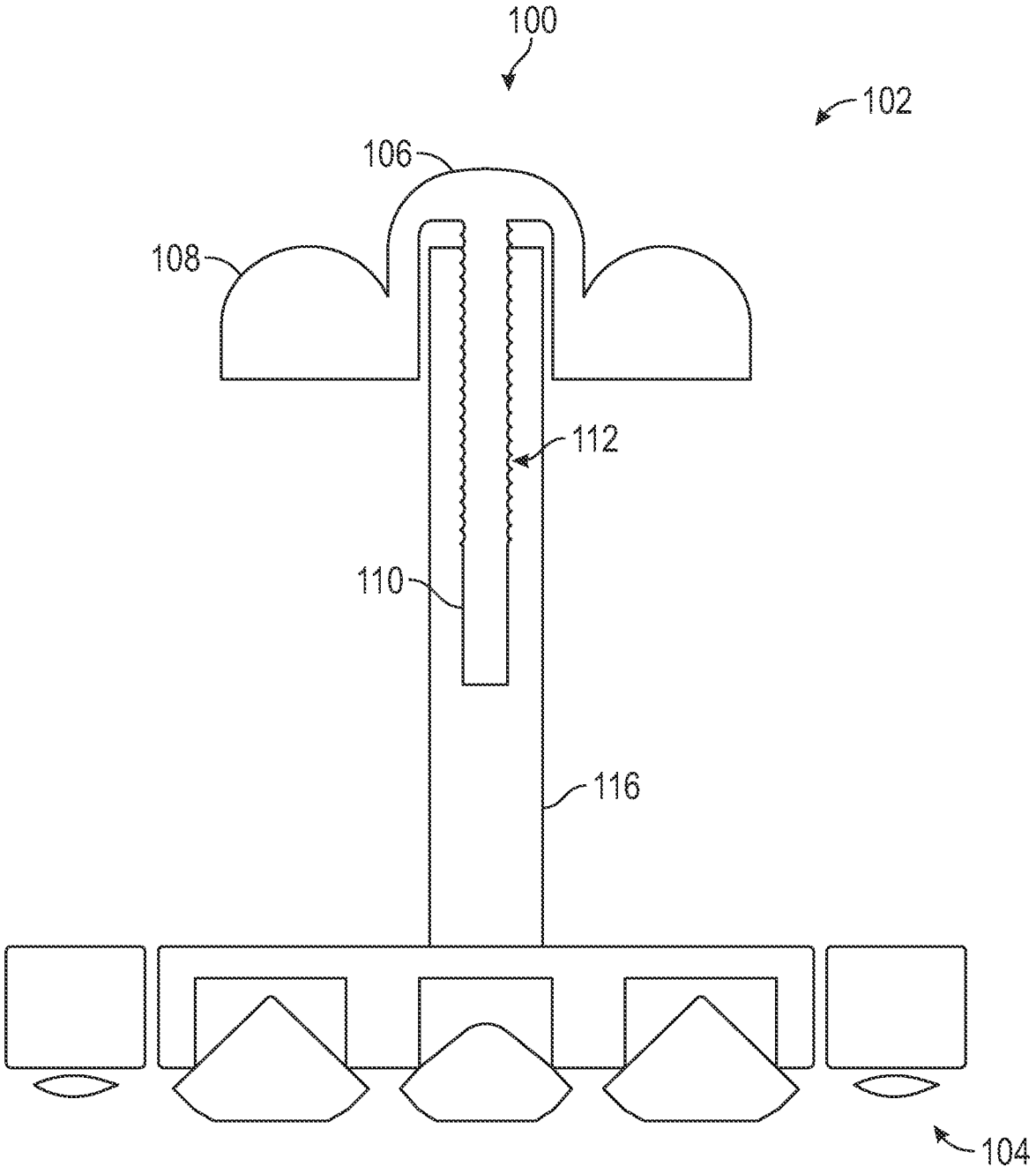
FIG. 5 shows a cross-sectional view of an earring having a frontal portion and a back portion, after the frontal portion is assembled with the back portion according to this disclosure.
Figure 6:
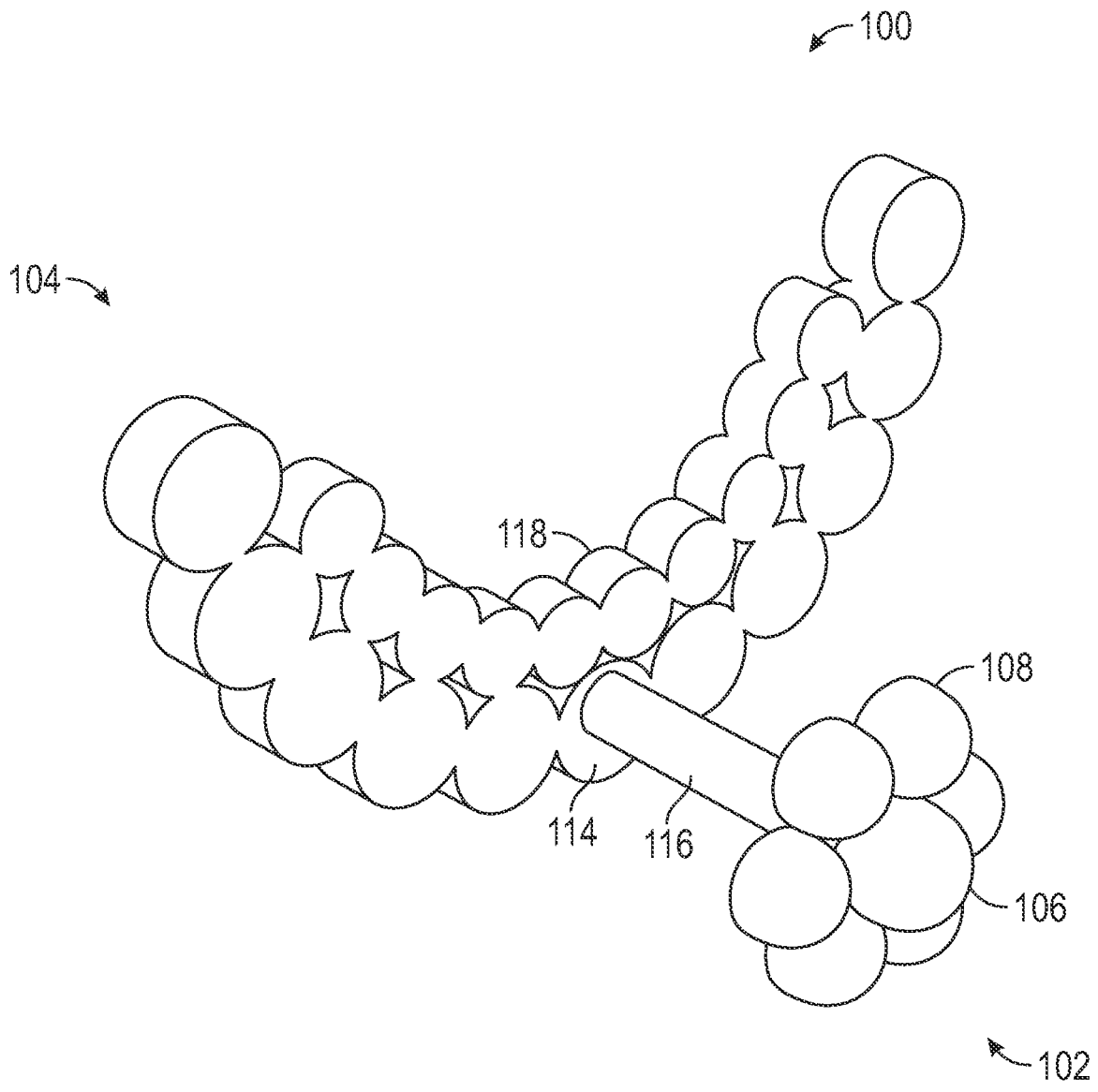
FIG. 6 shows a back perspective view of an earring having a frontal portion and a back portion, after the frontal portion is assembled with the back portion according to this disclosure.
Figure 7:
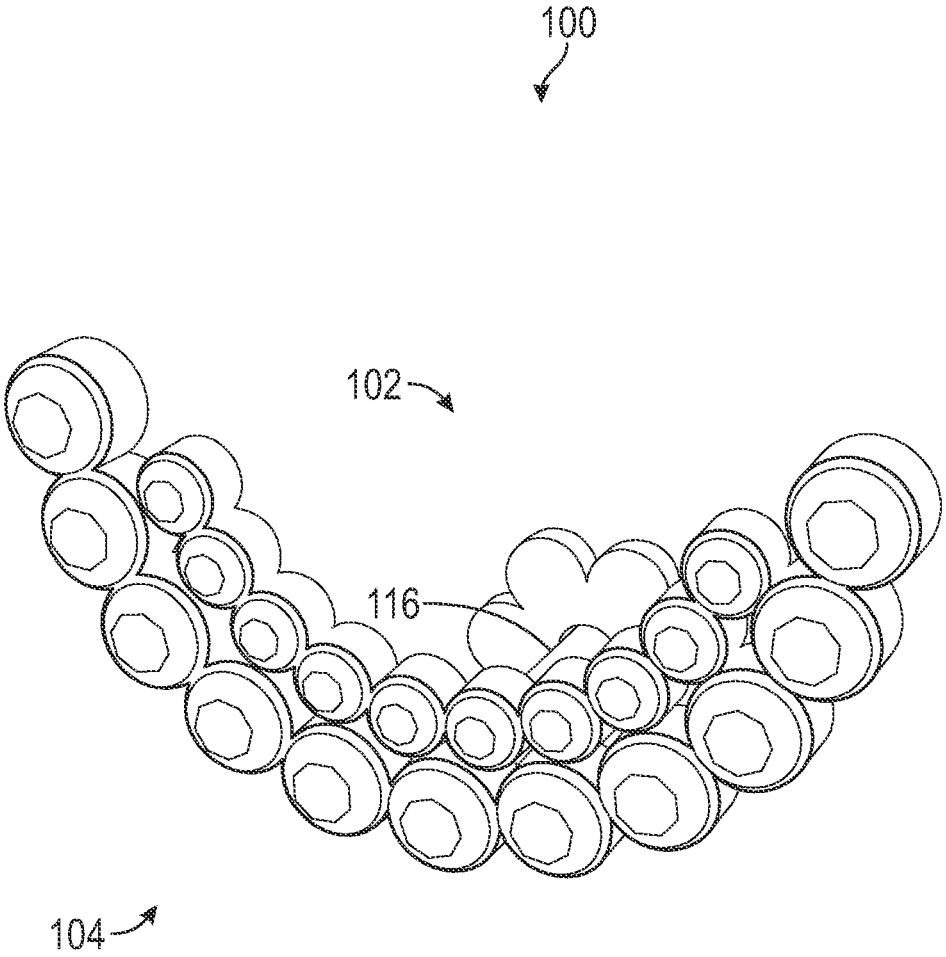
FIG. 7 shows a front perspective view of an earring having a frontal portion and a back portion, after the frontal portion is assembled with the back portion according to this disclosure.

FIG. 4 shows a top schematic view of an earring having a frontal portion and a back portion, after the frontal portion is assembled with the back portion according to this disclosure. FIG. 5 shows a cross-sectional view of an earring having a frontal portion and a back portion, after the frontal portion is assembled with the back portion according to this disclosure. FIG. 6 shows a back perspective view of an earring having a frontal portion and a back portion, after the frontal portion is assembled with the back portion according to this disclosure. FIG. 7 shows a front perspective view of an earring having a frontal portion and a back portion, after the frontal portion is assembled with the back portion according to this disclosure. In particular, prior to the earring 100 being shown, merchandized, or worn, the earring 100 is assembled via the back portion 102 fastening with the front portion 104.

This assembly occurs via the cavity of the housing 106 receiving the tube 116 into the cavity of the housing 106 such that the post 110 extends into the cavity of the tube 116 through the open end 120, and the post 110 and the tube 116 thread with each other via the helical threads 112 and the helical threads 122 while the tube 116 spans between the housing 106 and the base 114 and the tube 116 is within the cavity of the housing 106. For example, the post 110 can enter the tube 116 from the open end portion of the tube 116, where (a) the closed end portion is proximal to the base 114, (b) the tube 116 has the inner surface longitudinally extends between the open end portion and the closed end portion, (c) the inner surface of the tube 116 has a longitudinal length between the open end portion and the closed end portion, or (d) the inner surface is not fully internally threaded along the longitudinal length, as show in FIG. 3. For example, the post 110 can enter the tube 116 from the open end portion and to avoid contact with the closed end portion when the post 110 and the tube 116 thread with each other completely via the helical threads 112 and the helical threads 122. For example, the post 110 can contact or can avoid contacting the base 114 when the post 110 is completely threaded to the tube 116 via the helical threads 112 and the helical threads 122.

The earring 100 can be manufactured via a method including manufacturing (e.g., unitary, assembly) the back portion 102 (e.g., first piece) including the housing 106 and the post 110, where the housing 106 includes the cavity and the post 110 extends out of the housing 106 from within the cavity while the post 110 is externally threaded, as shown in FIG. 8. The method includes manufacturing (e.g., unitary, assembly) the front portion 104 (e.g., second piece) including the base 114 and the tube 116, where the tube 116 extends from the base 114 while the tube 116 is internally threaded, as shown in FIG. 9. The method includes causing the cavity to receive the tube 116 such that (a) the post 110 extends into the tube 116 and (b) the post 110 and the tube 116 thread with each other while the tube 116 spans between the housing 106 and the base 114, as shown in FIGS. 3-5.

The earring 100 can be used via a method including causing a user to hold a the back portion 102 (e.g., first piece) including the housing 106 and the post 110, where the housing 106 includes the cavity and the post 110 extends out of the housing 106 from within the cavity while the post 110 is externally threaded. The method includes causing the user to hold the front portion 104 (e.g., second piece) including the base 114 and the tube 116, where the tube 116 extends from the base 114 while the tube 116 is internally threaded. The method includes causing the user to form the earring 100 via the cavity receiving the tube 116 such that (a) the post 110 extends into the tube 116 and (b) the post 110 and the tube 116 thread with each other while the tube 116 spans between the housing 106 and the base 116.

Figure 10:
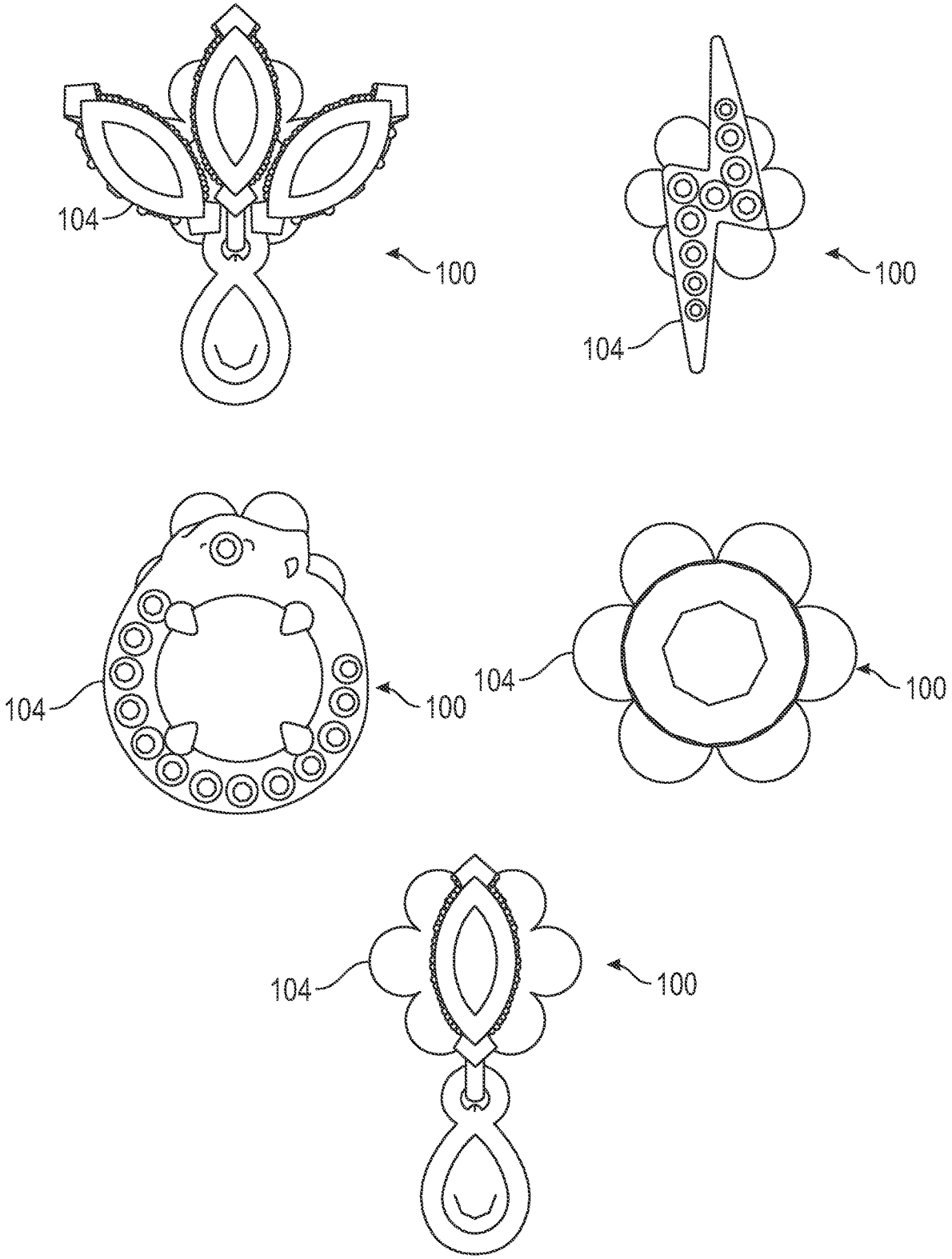
FIG. 10 shows a frontal view of a plurality of earrings according to this disclosure.

FIG. 10 shows a frontal view of a plurality of earrings according to this disclosure. In particular, the earrings 100 differ from each other via the frontal portions 104, as shown. For example, the decorative portions 108 are decoratively different from each other in visual appearance. Note that these decorative portions 108 are illustrative and other decorative portions are possible, as understood to skilled artisans, and are omitted solely for brevity purposes.

Figure 11:
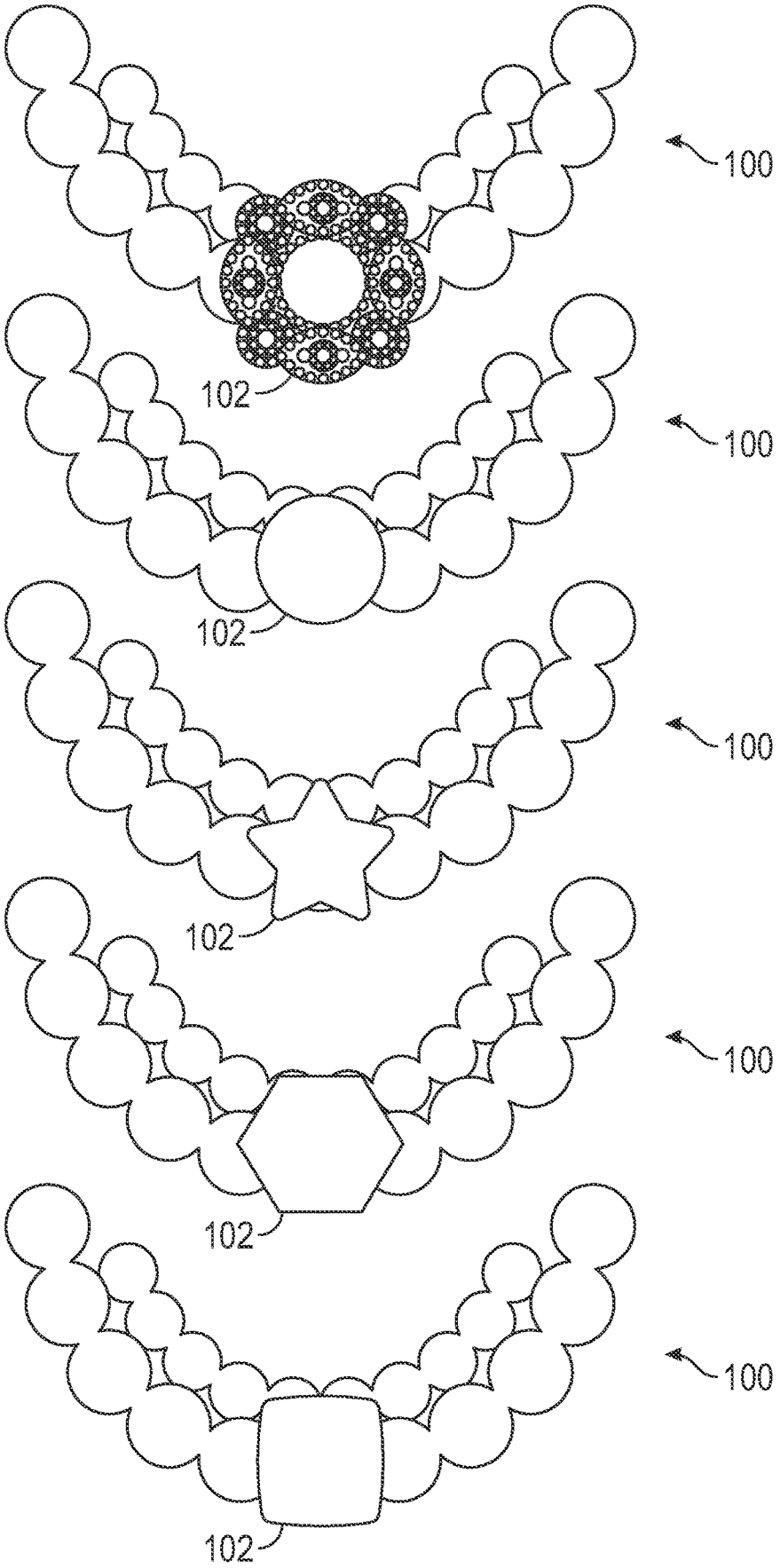
FIG. 11 shows a frontal view of a plurality of earrings according to this disclosure.

FIG. 11 shows a frontal view of a plurality of earrings according to this disclosure. In particular, the earrings 100 differ from each other via the back portions 102, as shown. For example, the decorative portions 118 are decoratively different from each other in visual appearance. Note that these decorative portions 118 are illustrative and other decorative portions are possible, as understood to skilled artisans, and are omitted solely for brevity purposes.

Figure 12:
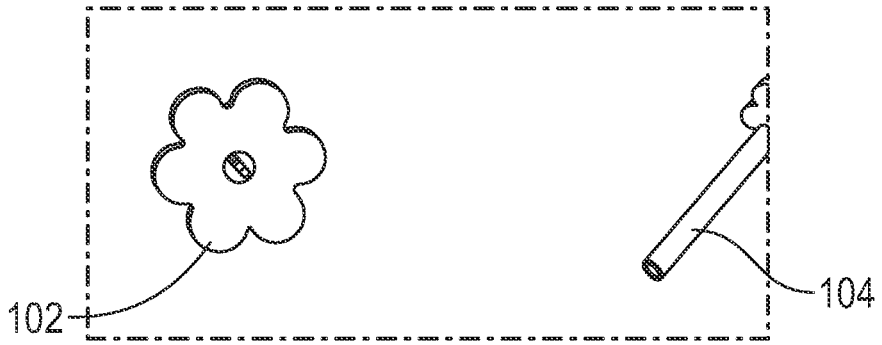
FIGS. 12 to 14 show a plurality of perspective views of a plurality of earrings according to this disclosure and FIG. 15 shows various housings according to this disclosure.
Figure 13:
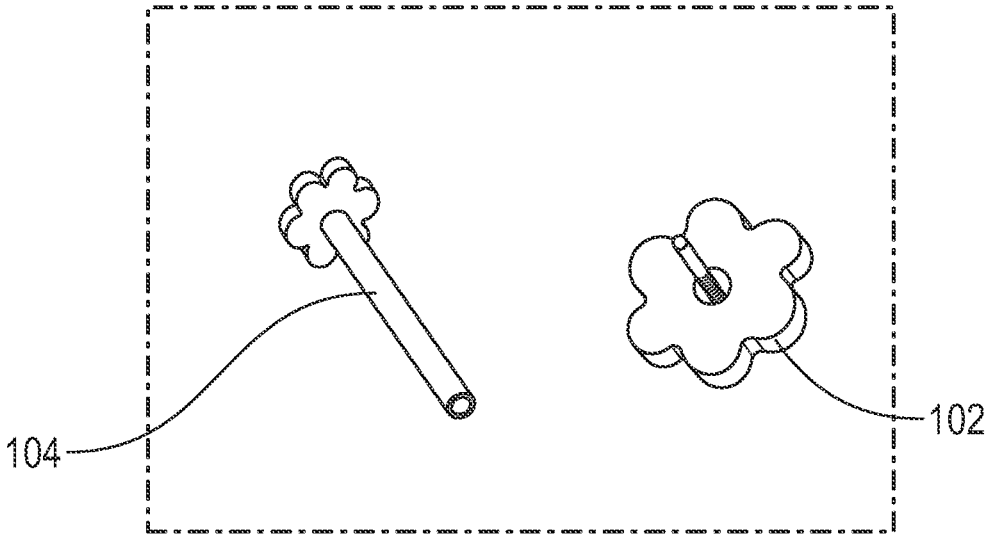
Figure 14:
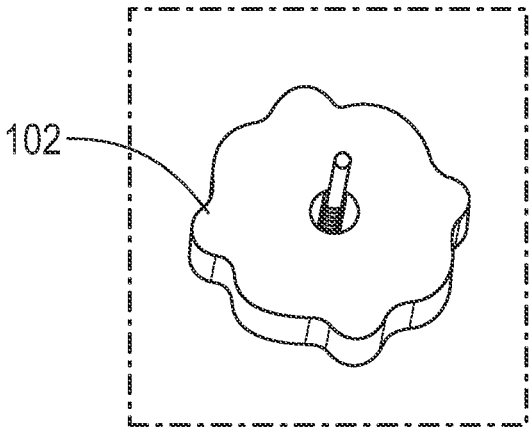
Figure 15:
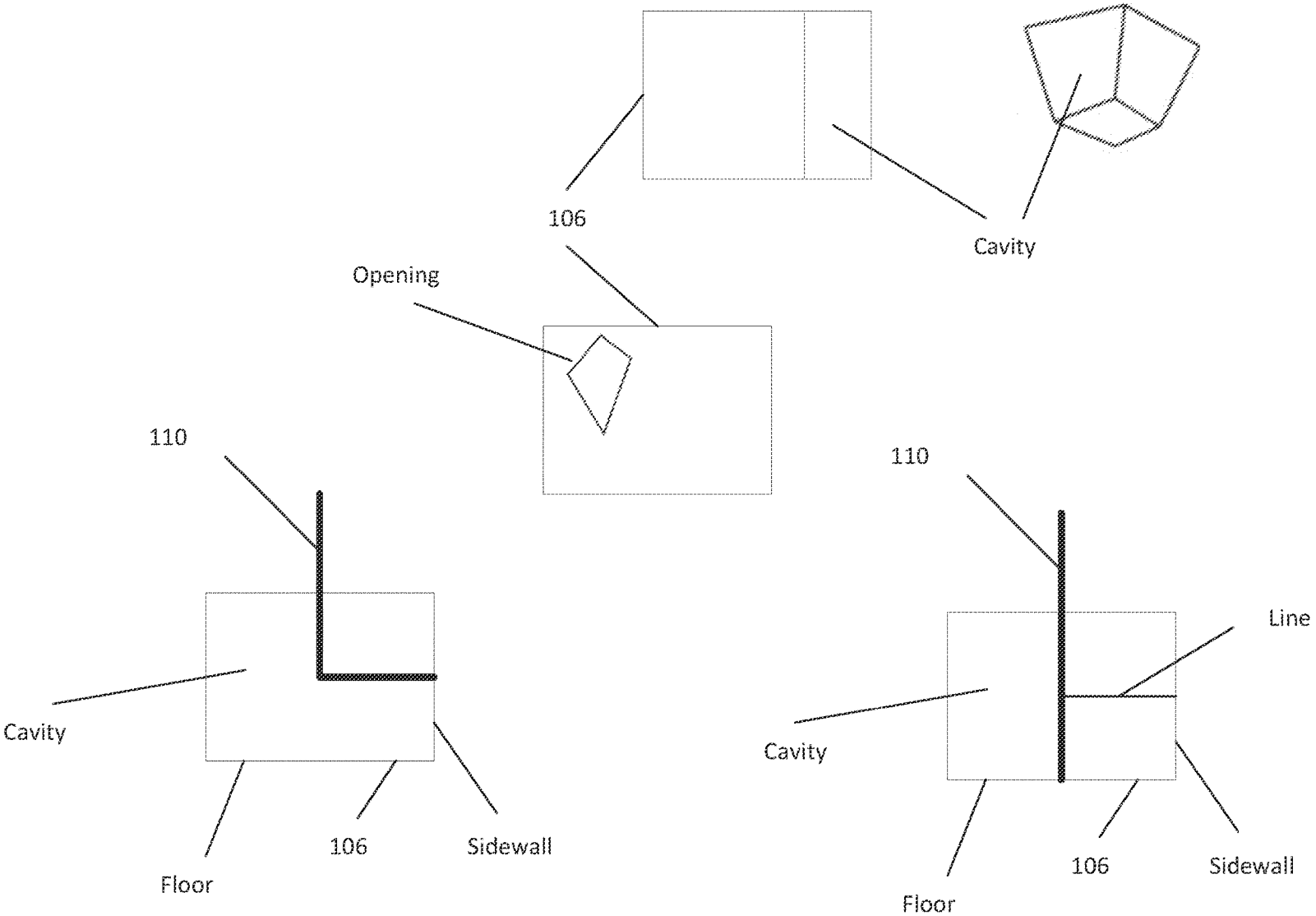

FIGS. 12 to 14 show a plurality of perspective views of a plurality of earrings according to this disclosure. In particular, each of these earrings 100 has the back portion 102 and the front portion 104. Note that any mix-and-match combinations between the back portions 102 and the front portions 104, as disclosed herein, are possible. For example, any decorative portion 108, as disclosed herein, can be mixed-and-matched in any combinatory or permutational manner with any decorative portion 118, as disclosed herein. For example, the back portion 102 and the front portion 104 can be reversed such that the back portion 102 is now the front portion 104 and the front portion 104 is now the back portion 102.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. An earring, comprising:

a housing including (i) a cavity having a length and an inner diameter and (ii) a substantially planar surface proximate to the cavity;

a post extending out of the housing from within the cavity past the substantially planar surface, wherein the post is externally threaded;

a tube that is internally threaded, wherein the tube has an outer diameter substantially equal to the inner diameter of the cavity; and a base from which the tube extends, wherein the cavity is configured to receive the tube such that (a) the post extends into the tube and (b) the post and the tube thread with each other such that the post and the tube are threadably engaged with each other at least within the length of the cavity while the tube spans between the housing and the base, wherein at least one of (1) the tube is unitary with the base and includes same material, (2) the tube having an open end portion from which the tube is internally threaded, (3) the post is a sole post within the tube, or (4) the post has a smooth terminating longitudinal portion immediately after the post is externally threaded and the smooth terminating longitudinal portion is internal to the tube when the post and the tube thread with each other while the tube spans between the housing and the base.

2. The earring of claim 1, wherein the post is unitary with the housing and includes same material.

3. The earring of claim 1, wherein the tube is unitary with the base and includes same material.

4. The earring of claim 1, wherein the post has a longitudinal length, wherein the post has an external surface extending along the longitudinal length, wherein the external surface is not fully externally threaded along the longitudinal length.

5. The earring of claim 1, wherein the housing includes an inner surface from which the post extends out of the housing from within the cavity.

6. The earring of claim 1, wherein the tube has an open end portion and a closed end portion, wherein the post is configured to enter the tube from the open end portion, wherein the closed end portion is proximal to the base, wherein the tube has an inner surface longitudinally extending between the open end portion and the closed end portion, wherein the inner surface has a longitudinal length between the open end portion and the closed end portion, wherein the inner surface is not fully internally threaded along the longitudinal length.

7. The earring of claim 1, wherein the tube has an open end portion and a closed end portion, wherein the closed end portion is proximal to the base, wherein the post is configured to enter the tube from the open end portion and to avoid contact with the closed end portion when the post and the tube thread with each other completely.

8. The earring of claim 1, wherein the housing has an opening into the cavity, wherein the opening is symmetrical.

9. The earring of claim 1, wherein the housing has an opening into the cavity, wherein the opening is asymmetrical.

10. The earring of claim 1, wherein the cavity has a volume that is symmetrical.

11. The earring of claim 1, wherein the cavity has a volume that is asymmetrical.

12. The earring of claim 1, wherein the post extend out of the housing from within the cavity in a cantilevered manner.

13. The earring of claim 1, wherein the post extend out of the housing from within the cavity not in a cantilevered manner.

14. The earring of claim 1, wherein the cavity has a floor and a sidewall, wherein the post extends from the floor, wherein the sidewall extends about the post.

15. The earring of claim 14, wherein the sidewall has a line extending therefrom such that the line spans between the sidewall and the post and thereby supports the post.

16. The earring of claim 1, wherein the cavity has a floor and a sidewall, wherein the post extends from the sidewall.

17. The earring of claim 16, wherein the post is at least one of L-shaped, V-shaped, or J-shaped.

18. The earring of claim 1, wherein the post is configured to avoid contacting the base when the post is threaded to the tube.

19. The earring of claim 1, wherein the post and the housing form at least one of a T-shape, an L-shape, a J-shape, or a mushroom shape.

20. The earring of claim 1, wherein the tube and the base form at least one of a T-shape, an L-shape, a J-shape, or a mushroom shape.

21. The earring of claim 1, wherein the housing includes an opening leading to the cavity, wherein the opening is centrally positioned on the housing.

22. The earring of claim 1, wherein the housing includes an opening leading to the cavity, wherein the opening is not centrally positioned on the housing.

23. The earring of claim 1, wherein the cavity is centrally positioned within the housing.

24. The earring of claim 1, wherein the cavity is not centrally positioned within the housing.

25. The earring of claim 1, wherein the cavity is symmetrical.

26. The earring of claim 1, wherein the cavity is asymmetrical.

27. The earring of claim 1, wherein the post has the smooth terminating longitudinal portion immediately after the post is externally threaded and the smooth terminating longitudinal portion is internal to the tube when the post and the tube thread with each other while the tube spans between the housing and the base.

28. The earring of claim 1, wherein the tube having the open end portion from which the tube is internally threaded.

29. The earring of claim 1, wherein the post is the sole post within the tube.

30. The earring of claim 1, wherein at least two of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

31. The earring of claim 1, wherein at least three of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

32. The earring of claim 1, wherein (1) the tube is unitary with the base and includes same material, (2) the tube having the open end portion from which the tube is internally threaded, (3) the post is the sole post within the tube, and (4) the post has the smooth terminating longitudinal portion immediately after the post is externally threaded and the smooth terminating longitudinal portion is internal to the tube when the post and the tube thread with each other while the tube spans between the housing and the base.

33. A method, comprising:

manufacturing a first piece of an earring including a housing and a post, wherein the housing includes (i) a cavity having a length and an inner diameter and (ii) a substantially planar surface proximate to the cavity, wherein the post extends out of the housing from within the cavity past the substantially planar surface, wherein the post is externally threaded;

manufacturing a second piece of the earring including a base and a tube, wherein the tube extends from the base, wherein the tube is internally threaded, wherein the tube has an outer diameter substantially equal to the inner diameter of the cavity; and causing the cavity to receive the tube such that (a) the post extends into the tube and (b) the post and the tube thread with each other such that the post and the tube are threadably engaged with each other at least within the length of the cavity while the tube spans between the housing and the base, wherein at least one of (1) the tube is unitary with the base and includes same material, (2) the tube having an open end portion from which the tube is internally threaded, (3) the post is a sole post within the tube, or (4) the post has a smooth terminating longitudinal portion immediately after the post is externally threaded and the smooth terminating longitudinal portion is internal to the tube when the post and the tube thread with each other while the tube spans between the housing and the base.

34. The method of claim 33, wherein the tube is unitary with the base and includes same material.

35. The method of claim 33, wherein the tube having the open end portion from which the tube is internally threaded.

36. The method of claim 33, wherein the post is the sole post within the tube.

37. The method of claim 33, wherein the post has the smooth terminating longitudinal portion immediately after the post is externally threaded and the smooth terminating longitudinal portion is internal to the tube when the post and the tube thread with each other while the tube spans between the housing and the base.

38. The method of claim 33, wherein at least two of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

39. The method of claim 33, wherein at least three of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

40. The method of claim 33, wherein (1) the tube is unitary with the base and includes same material, (2) the tube having the open end portion from which the tube is internally threaded, (3) the post is the sole post within the tube, and (4) the post has the smooth terminating longitudinal portion immediately after the post is externally threaded and the smooth terminating longitudinal portion is internal to the tube when the post and the tube thread with each other while the tube spans between the housing and the base.

41. A method, comprising:

causing a user to hold a first piece including a housing and a post, wherein the housing includes (i) a cavity having a length and an inner diameter and (ii) a substantially planar surface proximate to the cavity, wherein the post extends out of the housing from within the cavity past the substantially planar surface, wherein the post is externally threaded;

causing the user to hold a second piece including a base and a tube, wherein the tube extends from the base, wherein the tube is internally threaded, wherein the tube has an outer diameter substantially equal to the inner diameter of the cavity; and causing the user to form an earring via the cavity receiving the tube such that (a) the post extends into the tube and (b) the post and the tube thread with each other such that the post and the tube are threadably engaged with each other at least within the length of the cavity while the tube spans between the housing and the base, wherein at least one of (1) the tube is unitary with the base and includes same material, (2) the tube having an open end portion from which the tube is internally threaded, (3) the post is a sole post within the tube, or (4) the post has a smooth terminating longitudinal portion immediately after the post is externally threaded and the smooth terminating longitudinal portion is internal to the tube when the post and the tube thread with each other while the tube spans between the housing and the base.

42. The method of claim 41, wherein the tube is unitary with the base and includes same material.

43. The method of claim 41, wherein the tube having the open end portion from which the tube is internally threaded.

44. The method of claim 41, wherein the post is the sole post within the tube.

45. The method of claim 41, wherein the post has the smooth terminating longitudinal portion immediately after the post is externally threaded and the smooth terminating longitudinal portion is internal to the tube when the post and the tube thread with each other while the tube spans between the housing and the base.

46. The method of claim 41, wherein at least two of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

47. The method of claim 41, wherein at least three of (1) the tube is unitary with the base and includes same material, (2) the tube having the open end portion from which the tube is internally threaded, (3) the post is the sole post within the tube, or (4) the post has the smooth terminating longitudinal portion immediately after the post is externally threaded and the smooth terminating longitudinal portion is internal to the tube when the post and the tube thread with each other while the tube spans between the housing and the base.

48. The method of claim 41, wherein (1) the tube is unitary with the base and includes same material, (2) the tube having the open end portion from which the tube is internally threaded, (3) the post is the sole post within the tube, and (4) the post has the smooth terminating longitudinal portion immediately after the post is externally threaded and the smooth terminating longitudinal portion is internal to the tube when the post and the tube thread with each other while the tube spans between the housing and the base.

49. An earring, comprising:

a first piece;

a tube that is internally threaded and extending from the first piece, wherein the tube has an outer diameter, wherein the tube is internally threaded;

a second piece including (i) a cavity having a length and an inner diameter and (ii) a substantially planar surface proximate to the cavity, wherein the outer diameter of the tube is substantially equal to the inner diameter of the cavity; and a post including a threaded longitudinal portion and a smooth longitudinal portion, wherein the post extends out from the second piece from within the cavity past the substantially planar surface such that (a) the smooth longitudinal portion immediately follows the threaded longitudinal portion, (b) the threaded longitudinal portion immediately follows the second piece, and (c) the threaded longitudinal portion is interposed between the second piece and the smooth longitudinal portion, wherein the post ends along the smooth longitudinal portion, wherein the threaded longitudinal portion fastens with the tube when the post extends into the tube and an ear is interposed between the first piece and the second piece, wherein the threaded longitudinal portion and the tube thread with each other such that the threaded longitudinal portion and the tube are threadably engaged with each other at least within the length of the cavity.

50. The earring of claim 49, wherein the first piece is a front portion and the second piece is a back portion.

51. The earring of claim 49, wherein the first piece is a back portion and the second piece is a front portion.

52. The earring of claim 49, wherein the threaded longitudinal portion has a wider cross-section than the smooth longitudinal portion.

53. The earring of claim 49, wherein the second piece has a cavity from within which the post extends.

* * * * *